US008966803B2

(12) United States Patent
Dietel et al.

(10) Patent No.: US 8,966,803 B2
(45) Date of Patent: Mar. 3, 2015

(54) FIREARM SAFETY

(75) Inventors: Bernd Dietel, Horgen (CH); Johannes Aberl, Farchant (DE)

(73) Assignee: Armatix Invest GmbH, Zürich (CH)

( * ) Notice: Subject to any disclaimer, the term of this patent is extended or adjusted under 35 U.S.C. 154(b) by 57 days.

(21) Appl. No.: 13/378,537

(22) PCT Filed: Jun. 15, 2009

(86) PCT No.: PCT/EP2009/004283

§ 371 (c)(1),
(2), (4) Date: Apr. 6, 2012

(87) PCT Pub. No.: WO2010/145671

PCT Pub. Date: Dec. 23, 2010

(65) Prior Publication Data

US 2012/0180357 A1 Jul. 19, 2012

(51) Int. Cl.

| | |
|---|---|
| ***F41A 17/64*** | (2006.01) |
| ***F41A 17/46*** | (2006.01) |
| ***F41A 17/00*** | (2006.01) |
| ***F41A 17/06*** | (2006.01) |
| ***F41A 17/08*** | (2006.01) |
| ***F41A 17/32*** | (2006.01) |
| ***F41A 17/42*** | (2006.01) |
| ***F41A 17/72*** | (2006.01) |

(52) U.S. Cl.

CPC ..... *F41A 17/06* (2013.01); *F41A 17/08* (2013.01); *F41A 17/32* (2013.01); *F41A 17/42* (2013.01); *F41A 17/72* (2013.01)

USPC ..... 42/70.08; 42/70.06; 42/70.01

(58) Field of Classification Search

CPC ..... F41A 17/06; F41A 17/08; F41A 17/72

USPC ..... 42/70.01, 70.06, 70.08

See application file for complete search history.

(56) References Cited

U.S. PATENT DOCUMENTS

| | | | | |
|---|---|---|---|---|
| 5,192,818 | A * | 3/1993 | Martin | 42/70.01 |
| 5,937,557 | A * | 8/1999 | Bowker et al. | 42/70.01 |
| 5,966,859 | A * | 10/1999 | Samuels | 42/70.11 |
| 6,185,852 | B1 * | 2/2001 | Whalen et al. | 42/70.11 |
| 6,237,271 | B1 * | 5/2001 | Kaminski | 42/70.06 |
| 6,499,243 | B1 * | 12/2002 | Herzog | 42/70.07 |
| 6,539,658 | B1 * | 4/2003 | Hubert et al. | 42/70.08 |
| 6,563,940 | B2 * | 5/2003 | Recce | 382/120 |
| 6,785,995 | B2 * | 9/2004 | Herzog et al. | 42/70.07 |
| 6,785,996 | B2 * | 9/2004 | Danner et al. | 42/70.08 |
| 6,823,621 | B2 * | 11/2004 | Gotfried | 42/70.06 |
| 6,843,014 | B1 * | 1/2005 | Aponte et al. | 42/70.06 |
| 6,856,238 | B2 * | 2/2005 | Wootton et al. | 340/5.61 |
| 7,030,729 | B2 * | 4/2006 | Albanesi et al. | 340/5.61 |
| 7,441,362 | B1 * | 10/2008 | Kley | 42/70.01 |
| 2003/0097776 | A1 * | 5/2003 | Brosow | 42/70.01 |
| 2009/0007476 | A1 * | 1/2009 | Mauch et al. | 42/1.01 |
| 2010/0170131 | A1 * | 7/2010 | Zukowski | 42/70.08 |

* cited by examiner

*Primary Examiner* — Bret Hayes

(74) *Attorney, Agent, or Firm* — Miller, Matthias & Hull LLP

(57) ABSTRACT

A safety apparatus for a firearm including a release/locking device, which can be changed to a first state, which allows a shot to be fired, and to a second state, which prevents a shot from being fired. The safety apparatus also including a state changing device, which allows the release/locking blocking device to be changed from the first state to the second state or vice versa.

12 Claims, 18 Drawing Sheets

FIREARM SAFETY

CROSS-REFERENCE TO RELATED APPLICATIONS

This application is a U.S. national stage filing of International Patent Application No. PCT/EP2009/004283 filed on Jun. 15, 2009.

FIELD OF THE DISCLOSURE

The present invention relates in general to firearms and in particular to apparatuses and methods serving for preventing an unjustified, unauthorized use of firearms and/or for allowing an authorized use thereof.

BACKGROUND OF THE DISCLOSURE

Approaches serving for preventing an unauthorized use of firearms are known. Depending on whether or not there is an authorization to use a weapon, individual or several components inside the firearm are changed into positions, which allow a shot to be fired or prevent it from being fired, i.e. the firearm is unlocked or locked.

Furthermore, a firearm usable in dependence from an authorization is usually unlocked when a person holding the firearm is authorized to use the firearm. The person cannot fire a shot with the firearm without authorization.

OBJECT OF THE DISCLOSURE

It is an object of this invention to provide measures and means, which increase the safety when firearms are used on the basis of an authorization.

SUMMARY OF THE DISCLOSURE

In order to achieve this object, the present invention provides an apparatus, a firearm, a method and systems according to the independent claims. Preferred embodiments are defined in the dependent claims.

In particular, the present invention provides a safety apparatus, which is provided for a firearm. The safety apparatus comprises an release/locking device and a state changing device.

According to embodiments, the release/locking device is adapted to be changed into a first state for a shot release and into a second state, which prevents a shot release. States, which allow a shot release comprise e.g. a state where the trigger of the weapon is blocked up to a state, in which the percussion cap cannot be ignited, e.g. by blocking the firing pin or by preventing the firing pin from being actuated (e.g. by the hammer of the firearm or by external forces exerted violently or accidentally, e.g. when the firearm is dropped). Without intending a limitation to a conventional firearm locking, it can be said that such states result in an unlocked firearm, while states, which prevent a shot release lead to a locked firearm.

In such embodiments, the state changing device is adapted to only change the release/locking device from the first state into the second state in response to the initiation of a firearm internal process for a shot release when there is no authorization information. Firearm internal processes for a shot release comprise, e.g., the (also only initial) actuation or contact of the trigger, processes proceeding in the firearm when the trigger is actuated (e.g. movement of the trigger bar, electric and/or electronic signals for controlling the firearm, e.g. for target acquisition, activating motors, actuators, etc., serving for firing a shot, loading ammunition, etc., cocking the hammer, etc.).

The authorization information provides an authorization to use the firearm and in particular for a shot release. The authorization information can be provided e.g. in the form of a signal, individual or several data or by means of other information-carrying means. The authorization information can be transmitted to the safety apparatus, e.g. by the device for checking the authorization of the firearm and/or an external apparatus or system. Only when such a process is triggered or initiated and no authorization information is available, the state changing device changes the release/locking device from the first state for a shot release into a second state which prevents a shot release.

The safety apparatus can also comprise a state maintaining device adapted to maintain the release/locking device in the second state in response to the initiation of a firearm internal process for a shot release when authorization information is available. This can be a firearm internal process for a shot release the same as that to which the state changing device responds, or it can be another firearm internal process for a shot release. When the or another firearm internal process for a shot release is available and authorization information is also available, the state maintaining device serves for maintaining the release/locking device in the first state for a shot release or for preventing that this state is not abandoned at least until a shot has been fired. The state maintaining device can be provided in addition to or in place of devices of the firearm as such, for example, which maintain the firearm in the unlocked operating state.

A release/locking device and a state changing device are also provided in further embodiments. Here, too, the release/locking device is adapted to be changed into a first state for a shot release and into a second state, which prevents a shot release. However, the here provided state changing device is adapted to only change the release/locking device from the second state into the first state in response to the initiation of a firearm internal process for a shot release when authorization information is available. In other words, when a firearm internal process for a shot release is triggered or initiated and authorization information is also available, the state changing device changes the release/locking device from the second state, which prevents a shot release, into the first state for a shot release. It is here possible that the release/locking device is already in the second state or can be changed into the second state before the state changing device changes the release/locking device into the first state.

In addition, the safety apparatus can comprise a state maintaining device adapted to maintain the release/locking device in the second state in response to the initiation of a firearm internal process for a shot release when there is no authorization information. This can also be a firearm internal process for a shot release the same as that to which the state changing device responds, or it can be another firearm internal process for a shot release. When the or another firearm internal process for a shot release is available and in the absence of authorization information, the state maintaining device serves for maintaining the release/locking device in the second state, which prevents a shot release, or for preventing that this state is not abandoned at least until there is, e.g., an authorization to use the firearm, in particular for firing a shot. The state maintaining device can be provided in addition to, or in place of, devices of the firearm as such, for example, which maintain the firearm in the unlocked operating state.

In general, the safety apparatus can comprise an actuation device designed depending on the embodiments of the safety apparatus.

In embodiments, in which the state changing device is adapted to only change the release/locking device from the first state into the second state in response to the initiation of a firearm internal process for a shot release when there is no authorization information, the actuation device can be adapted to change the release/locking device from the second state into the first state in response to the initiation of the or a firearm internal process for a shot release, preferably before the state changing device interferes.

In embodiments, in which the state changing device is adapted to only change the release/locking device from the second state into the first state in response to the initiation of a firearm internal process for a shot release when authorization information is available, the actuation device can be adapted to change the release/locking device from the first state into the second state in response to the initiation of the or a firearm internal process for a shot release, here also preferably before the state changing device interferes.

The actuation device and the state changing device can be provided as separate devices, can have jointly used components and have components of their own or can be designed as a device, which serves as an actuation device and a state changing device, and/or provides its functions in a structurally uniform and integrated fashion.

The actuation device can be adapted to change the state of the release/locking device in a first time period.

It is also possible that the state changing device is adapted to change the state of the release/locking device in a second time period. If available, it may be provided that the state maintaining device maintains the release/locking device in the respective state in the or a second time period. The time periods in which the state changing device and/or the state maintaining device operate, can at least partially overlap or can be substantially identical.

The first and second time periods (and also further time periods mentioned below) can be time periods of a motion sequence in the firearm, e.g. movements of a trigger bar of the weapon, adapted to be effected by the trigger of the firearm. Further examples are movements of the trigger, movements of the firing pin, processes serving for conveying a cartridge from the magazine into the cartridge chamber, etc.

The indication "in" a time period includes that the respective process (e.g. changing the release/locking device from the first state into the second one) takes a time, which is shorter than that of the associated time period or takes the substantially entire duration of the time period.

The second time period preferably follows directly the first time period. In further designs, an intermediate time period can be present between the first and second time periods. In such an intermediate time period, e.g. electric, electronic and/or mechanical processes may take place, which are correlated with the operation/use of the weapon, for example. In such an intermediate segment, a cartridge could be conveyed into the cartridge chamber where it is positioned and/or a check-up can be performed as to whether or not there is an authorization to use the weapon. Furthermore, control operations, processes for target acquisition, etc., may take place.

It is provided that in such an intermediate segment, the release/locking device remains or is maintained in its respective state. This can be achieved by means of the actuation device, for example, when it does not change its state or does not change it in such a way that the respective state of the release/locking device is abandoned. This can also be achieved—by way of alternative or supplement—by the state maintaining device.

The actuation device and/or the state changing device can be adapted to be used to return the release/locking device to the respective initial state when its state was changed. This can be done in a third time period. The third time period can directly follow the second one or start at a distance of time from it.

The release/locking device can comprise a firing pin for the firearm. As to the first state of the release/locking device, the firing pin can be in a first position, which prevents a shot release, and as to the second state of the release/locking device it can be in a second position for a shot release. For example, the firing pin can be rotatable, tiltable and/or (longitudinally/transversely) slidable depending on the design of the firearm to adopt the first position and a second position.

The release/locking device can comprise a stop adapted to limit a firing pin movement for a shot release when it is in its first position.

The release/locking device can comprise a transmission element, which preferably includes a resilient material. The transmission element is intended to protect the release/locking device, the firing pin and/or other components of the weapon from damage when a non-authorized person tries to fire a shot, in particular by at least partially receiving or absorbing forces, which would effect an actuation of the firing pin. The transmission element can be adapted to serve for transmitting forces, in particular of the hammer, for initiating a shot to be fired when the user is authorized to use the weapon.

In the first state of the release/locking device, the transmission element can be adapted to be relatively (e.g. with respect to another component of the release/locking device) movable therein and in the second state of the release/locking device it can be adapted to be fixed therein at least to such an extent that a shot can be fired (e.g. by coupling with a component of the release/locking device or by substantially limiting movements of the transmission element).

In further embodiments, it is provided that the transmission element is relatively movable with respect to the firing pin in the first state of the release/locking device while the transmission element can be adapted to actuate the firing pin in the second state of the release/locking device.

In particular, it is possible that, when the transmission element is movable, no shot is fired, e.g. since the transmission element "absorbs" or compensates for forces, momentums and/or movements, which would otherwise trigger a shot. When the transmission element is fixed or movements of the transmission element of the release/locking device are substantially limited, a shot can be fired by transmitting e.g. forces, momentums and/or movements, which initiate a shot, by the transmission element.

For example, it is possible that the transmission element is movable relative to the firing pin in the first state of the release/locking device and that it cannot act on it, or cannot act on it so as to initiate a shot. In the second state of the release/locking device, the transmission element cooperates with the firing pin or can be adapted to at least cooperate in such a way that a shot can be fired.

The engagement of the transmission element and the firing pin can be of mechanical, hydraulic and/or pneumatic nature. Such an engagement is also referred to below as a direct engagement. By way of alternative or supplement, an electric and/or electronic control can be used, which effects the actuation by using one or several controllable actuators, for example. Such a coupling is also referred to below as an indirect engagement, which can be wired, and/or wireless.

For engagement, the actuation device can be designed with a trigger bar of the firearm and can be actuated by means of the trigger bar.

The actuation device can comprise a control element adapted to be moved by a link motion, which is attached to the trigger bar, or can be connected therewith, for example, wherein the link motion is actuated in response to an actuation of the trigger of the firearm.

The actuation device can be in direct (e.g. mechanical, hydraulic and/or pneumatic) and/or indirect (e.g. electric and/or electronic) engagement with the release/locking device as a whole or with one component thereof, e.g. with the firing pin.

The state maintaining device can comprise at least one component having two states, which can be adapted depending on existing or lacking authorization information. This is in particular understood to mean that the state maintaining device has or adopts a first state, when there is no authorization information, and has or adopts a second state when there is authorization information. In the first state, the state maintaining device can be adopted to be in direct and/or indirect engagement with the release/locking device, for example, whereas the state maintaining device can be adapted to directly and/or indirectly cooperate with the release/locking device in/at its second state. The two states of the state maintaining device can be achieved e.g. by using a bistable element, a piezoelectric actuator, a switchable catch or hook, etc.

In further variants, the state maintaining device can (also) comprise at least one component adapted to be magnetized depending on available or lacking authorization information. This component can comprise e.g. at least one controllable electromagnet adapted to be activated in response to authorization information and/or at least one element having a magnetic polarization adapted to be changed in controlled fashion depending on the authorization information and/or at least one element adapted to be magnetized and demagnetized, as desired, e.g. a soft magnetic element.

The state maintaining device can comprise a holding element adapted to cooperate e.g. with the release/locking device, preferably with the firing pin. For example, the holding element can be held by the component with two states and/or by the magnetizable component in response to authorization information in a holding position, which at least partially prevents that the state of the release/locking device is maintained. Without authorization information, the holding element preferably is adapted to not cooperate with the release/locking device or is adapted to not cooperate with it in a way, which permits, or at least does not prevent, the change in the state of the release/locking device.

The state changing device can comprise at least one element producing restoring forces and/or momentums for the release/locking device, preferably at least one of the following components: a spring, a bimetal, a magnetic actuator, a motor-driven actuator, a piezoelectric actuator, an element where the magnetic poles can be reversed. In the case of a spring, it can be tensioned e.g. in response to the or a firearm internal process for a shot release, wherein the spring is released again to return the release/locking device into its respective initial state. A bimetal, actuator, e.g. a magnetizable element, can be activated (or deactivated), when there is no authorization signal, for example, to provide the energy, which returns the release/locking device into its respective initial state.

By way of supplement or alternative, the state changing device can be designed to change, after a shot is fired, the safety apparatus (back) into a state, in which no shot can be fired or the firearm is locked. This can be force-controlled, for example, wherein processes, which take place in the firearm after a shot is fired (e.g. movements of the firing pin), can effect a reset of the safety apparatus. In particular, the state changing device can be designed so as to return the release/locking device into the initial state in response to movements, which take place in the firearm after a shot is fired.

The state changing device can comprise e.g. a guide structure (e.g. recess with guide surface(s) and/or protruding guide surface(s)) formed in and/or at a stationary part of the firearm (e.g. handle), adapted to directly and/or indirectly cooperate with the holding element and/or the actuation element. For example, the cooperation can be such that, after firing a shot, one or more components of the firearm (e.g. firing pin) also move the guide structure and/or the state maintaining device and/or the actuation device. A relative movement of the guide structure and state maintaining device and/or actuation device with respect to one another, which occurs in this connection, can produce forces and/or momentums, which act (directly or indirectly) on the holding element and/or the actuation element, for example, and move them such that the release/locking device is returned to its respective initial state.

The state changing device can be in direct or indirect engagement with the actuation device and/or can be directly and/or indirectly coupled thereto.

The safety apparatus can comprise a control device for generating authorization information. The control device can be designed to detect whether there is an authorization to use the firearm and to then generate, or not generate, authorization information. The control device can receive information on an authorization regarding the use of the weapon by a separate authorization detection or checking apparatus adapted to be arranged in the firearm as such or can be provided as an external apparatus.

Furthermore, the safety apparatus can have an energy supply to supply energy to the release/locking device, the state maintaining device, the state changing device and/or the control device, for example. The energy supply can be disposed in the handle (comprising one or more batteries and/or accumulators, for example), adjacent to the magazine in the handle or adjacent to the barrel. The energy supply can also partially be designed in portable fashion (by the user of a weapon) and transmit energy to the firearm by means of inductive and/or capacitive transmission, for example.

A receiving apparatus can also be provided to receive information, which gives an authorization to use the firearm in particular for firing a shot. Such information can be provided e.g. by means of electric, magnetic, optical and/or radio transmission (e.g. RF signals, Bluetooth, wireless LAN, GSM/UMTS, GPS, Galileo, GLONASS, etc.).

In addition, a so-called failsafe device can be provided, which, when the functioning of the safety apparatus and/or the firearm is at least partially deficient, is adapted to change the release/locking device into a failsafe state, in which the firing of a shot is basically allowed. Failsafe devices comprise means serving for preventing that with an at least partially deficient operation of the safety apparatus and also of the firearm as such the firearm can be used and in particular a shot can be fired. For this purpose, the release/locking device is changed into what is called a failsafe state. Depending on the embodiment, failsafe states comprise "bridging" or deactivating the release/locking device or achieving and/or maintaining a state for the release/locking device such that it does not exercise the function of preventing a shot release. Such embodiments can be advantageous e.g. for police weapons, army firearms, etc., to be able to basically fire a shot in the case of a failure and in particular in emergency situations.

The present invention also provides a firearm having a safety apparatus according to the invention.

The firearm can comprise a trigger, a trigger bar cooperating with the trigger and the release/locking device, and a hammer cooperating with the trigger bar. In the case of firearms where the release of a shot comprises at least partially non-mechanical processes (e.g. control signals), it is provided that the corresponding non-mechanical components cooperate with the release/locking device and/or the hammer in a comparable way.

The link motion of the safety apparatus, if available, and the trigger bar can be in engagement with each other. The link motion, if available, can be mounted on the trigger bar or be actuated by it.

Preferably, the energy supply of the safety apparatus can be arranged at least partially in the firearm (e.g. in the handle) and/or can be connected therewith.

The control device of the safety apparatus can be arranged at least partially in or at the barrel and/or in the handle of the firearm.

The present invention additionally provides a method for locking a firearm depending on an authorization to use the firearm. The above, supplementary information on the safety apparatuses according to the invention apply correspondingly to methods according to the invention and are thus not repeated herein.

In an embodiment of the method, the firearm is only changed into a state in response to an initiation of a firearm internal process for a shot release when there is no authorization to use the firearm.

In such embodiments, a state of the firearm for a shot release can be maintained in response to an initiation of the or a firearm internal process for a shot release when there is an authorization to use the firearm.

It is also possible that, in response to an initiation of the or a firearm internal process for a shot release, the firearm is initially changed into a state for a shot release.

In further embodiments of the method, the firearm is only changed into a state for a shot release in response to the initiation of a firearm internal process for a shot release when there is an authorization to use the firearm.

In these embodiments, a state of the firearm, which prevents a shot release, can be maintained in response to the initiation of the or a firearm internal process which takes place within the firearm and for a shot release when there is no authorization to use the firearm.

It is also possible to initially bring the firearm into the operating state, which prevents a shot release in response to the initiation of the or a firearm internal process for a shot release.

It is preferably only checked in response to an initiation of the or a firearm internal process for a shot release whether there is an authorization to use the firearm.

The evaluation of whether there is an authorization to use the firearm, can be carried out internal the firearm. For example, the firearm can comprise devices to determine and/or receive information, which indicates whether the firearm can be used and, in particular, a shot a can be fired.

In addition or as option, the evaluation as to whether there is an authorization to use the firearm can be carried out external the firearm and the evaluation result can be provided to the firearm. Carrying out the authorization internal the firearm and external the firearm can result in enhanced safety and better protection against the non-allowed/non-desired use of the firearm.

Further, information indicating an authorization to handle the firearm can be determined or generated, wherein depending thereon the firearm is changed into an operative state or a state, in which the firearm is not ready for operation. Such embodiments allow, for example, to initially check (e.g. when the weapon is taken out of a weapon cabinet or when it is gripped) whether a user is basically authorized to use the firearm and/or whether the firearm can be used in a certain area (e.g. shooting stand) and/or whether a shot may be fired into a certain area (e.g. area between shooter and target) or whether it may not be fired (e.g. in direction to a beater). If this is the case, the firearm can be "unlocked" so that upon a subsequent evaluation as to whether there is an authorization to fire a shot, a shot can be fired. Even when there is an authorization to fire a shot, no shot can be fired without authorization to handle the firearm.

It can be checked in such embodiments whether there is a certain type of authorization to handle the firearm, and authorization type information, which indicates the evaluation result, is provided to the firearm. This permits e.g. to classify persons in different groups of users, authorization classes, etc., and to define allowed and/or non-allowed spatial areas and/or periods of time for using firearms, allowed and/or non-allowed spatial areas where shots can be fired or cannot be fired.

In further variants it is checked whether the authorization type information indicates that firing a shot is to be basically allowed when at least one of the steps provided in response to the initiation of a firearm internal process for a shot release cannot be carried out on account of a failure within the firearm. These embodiments can be used, for example, to be able to use e.g. police weapons or army firearms even when the firearm, components thereof, in particular a safety apparatus according to the invention, and/or devices used with the firearm (e.g. external means for checking the authorization) at least partially fail to function properly.

The present invention also provides a system, which comprises a firearm according to the invention and a firearm external authorization evaluation unit. When there is an authorization to use and/or handle the firearm, the firearm external authorization evaluation unit is adapted to generate an enabling signal and transmit it to the firearm, wherein the safety apparatus according to the invention is adapted to change or maintain the state of the release/locking device, in which a shot release is allowed, only when the enabling signal is received.

The present invention also provides a system, which comprises a firearm according to the invention and a firearm external shooting area detection unit. The shooting area detection unit outside the firearm is adapted to determine whether a current firing of a shot results in a shot at least in a certain area.

The shooting area detection unit preferably generates an enabling signal when a current firing of a shot results in a shot in a first determined area.

In such variants, it is provided that the safety apparatus only allows a shot to be fired when an enabling signal is present.

In addition or as option, the shooting area detection unit can produce a locking signal when a current firing of a shot results in a second determined area.

In such variants, it is provided that the safety apparatus only permits the firing of a shot in the absence of a blocking signal.

The above systems can be combined into a system arrangement according to the invention.

BRIEF DESCRIPTION OF THE DRAWINGS

In the below description, reference is made to the following drawings, which show FIGS. 1 and 2 schematically illustrations of a firearm according to the invention, FIGS. 3*a* and 3*b* schematically illustrations of a safety apparatus according to the invention, FIG. 4 a schematically illustration of a further embodiment of the safety apparatus, FIGS. 5*a*, 5*b* and 5*c* schematically illustrations of a safety apparatus according to the invention comprising an release/locking device in an initial state, FIG. 6 a schematically illustration of a safety apparatus according to the invention comprising the release/blocking device in an initial state, FIGS. 7*a*, 7*b* and 7*c* schematically illustrations of the safety apparatus of FIG. 5, wherein the release/locking device is in a state for a shot release, FIG. 8 a schematically illustration of the safety apparatus of FIG. 6, wherein the release/locking device is in a state for a shot release, FIGS. 9*a* and 9*b* schematically illustrations of the safety apparatus of FIG. 5 according to the invention, wherein the safety apparatus is in a state for a shot release in the presence of an authorization to use the firearm, FIG. 10 a schematically illustration of the safety apparatus of FIG. 6, wherein the release/locking device is in a state for a shot release in the presence of an authorization to use the firearm, FIGS. 11*a* and 11*b* schematically illustrations in partial views, of the release/locking device in a state preventing a shot release in the presence of an authorization to use the firearm, FIGS. 12*a* and 12*b* schematically illustrations of the safety apparatus of FIG. 5 according to the invention, wherein the release/locking device is in a state preventing a shot release in the absence of an authorization to use the firearm, FIG. 13 a schematically illustration of the safety apparatus of FIG. 6, wherein the release/locking device is in a state preventing a shot release in the absence of an authorization to use the firearm, FIGS. 14*a* and 14*b* schematically illustrations, in partial views, of the release/locking device in a state for a shot release in the absence of an authorization to use the firearm.

DETAILED DESCRIPTION OF THE DISCLOSURE

Figure 2:
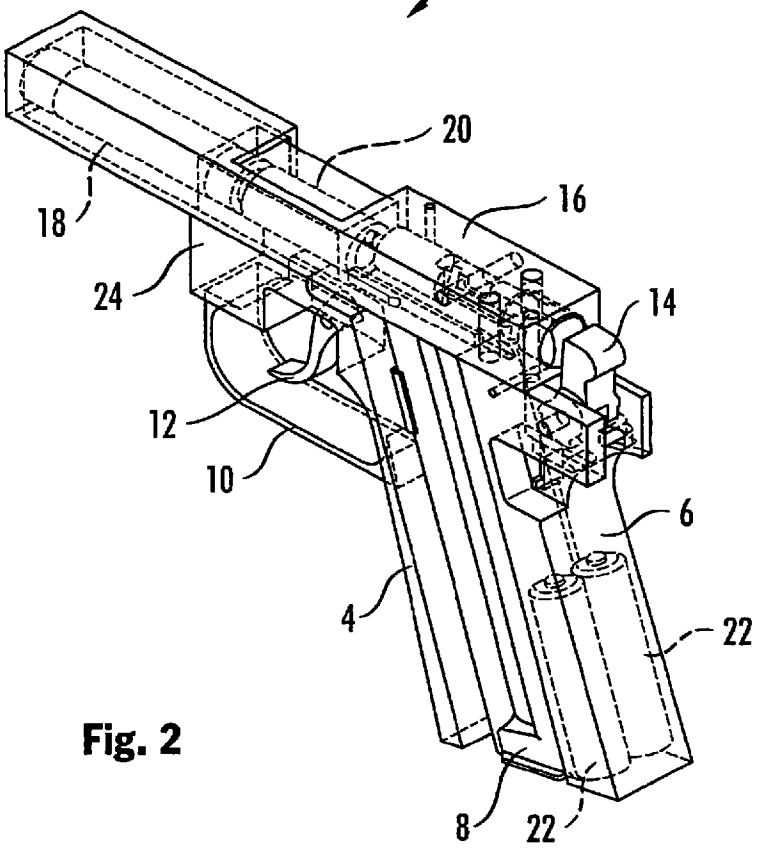
Figure 1:
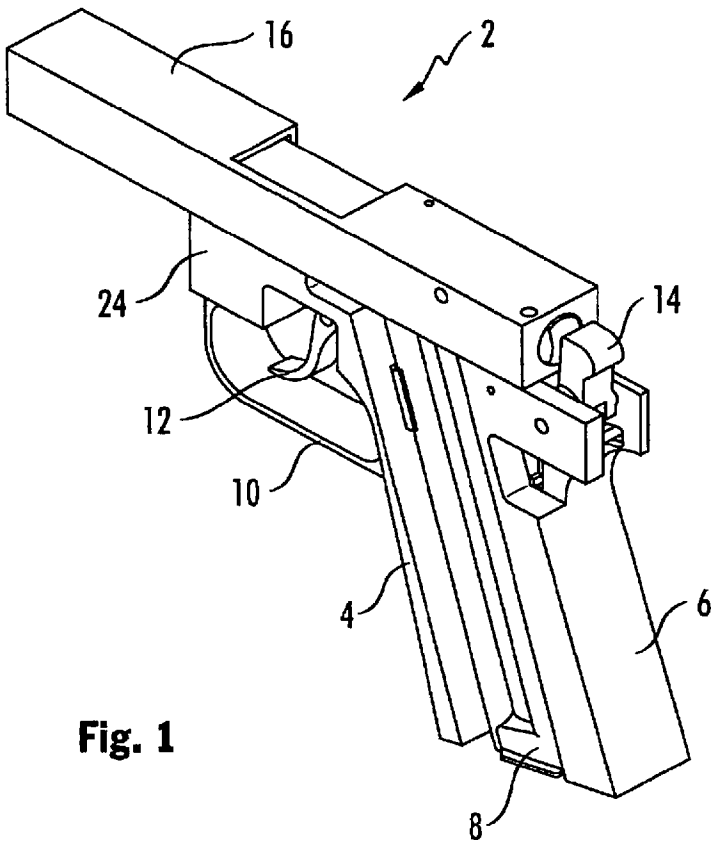
Figure 3B:
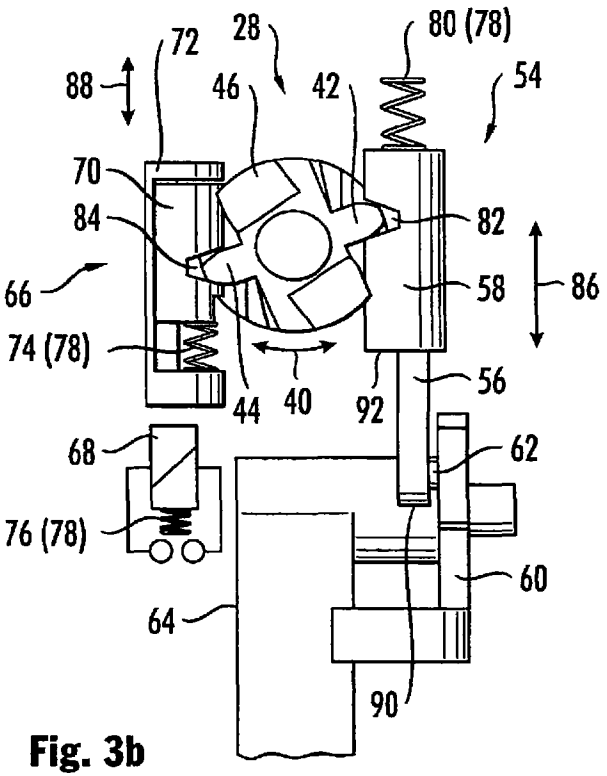
Figure 3A:
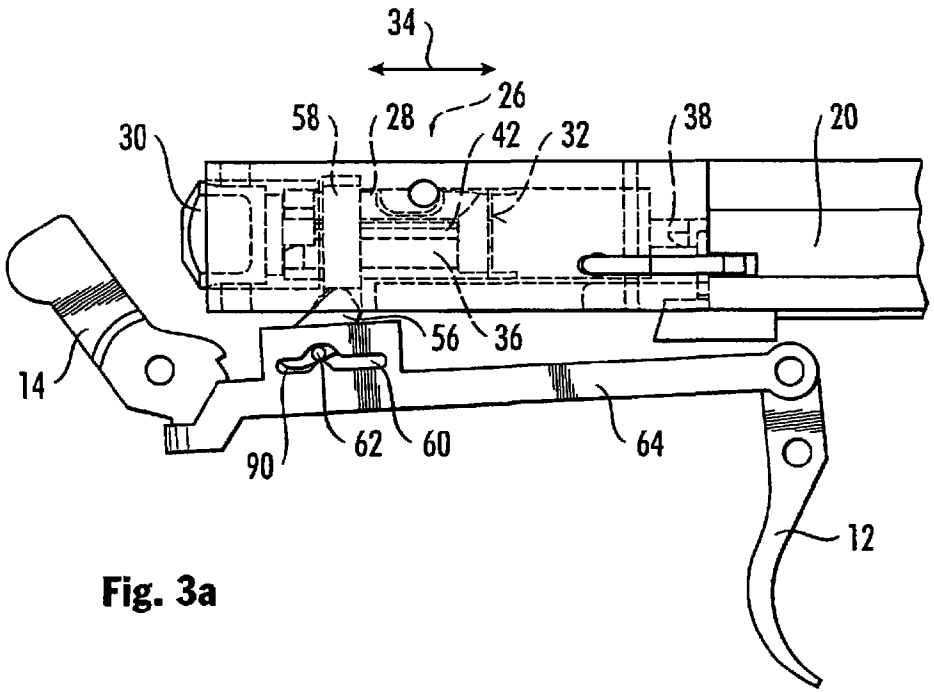

FIGS. 1 and 2 show schematically a firearm 2, which includes an integrated safety apparatus. Such a safety apparatus is described in more detail below with reference to FIGS. 3 to 16. FIGS. 1 and 2 show the firearm 2 without handle plates. The firearm 2 comprises a handle 4 where a magazine 8 is arranged in its handle part 6. In the firearm 2 as shown, the handle 4 extends from the right-hand lower end of the handle part 6, according to the figures, to the left-hand upper end at the muzzle opening, as illustrated. FIGS. 1 and 2 also show a trigger guard 10, a trigger 12, a hammer 14 and a slide 16. A barrel 18 and a separately designed cartridge chamber 20 are arranged in the handle piece 6, as shown in the figures.

An energy supply 22 for the safety apparatus can be accommodated in the handle 4, e.g. in the handle part 6, in the form of batteries or accumulators, for example.

In order to control the safety apparatus, a control device (not shown) is provided adapted to be integrated into the safety apparatus or can be provided as a separate component with respect thereto. In the latter case, the control device can be arranged e.g. in the handle 4 adjacent to the safety apparatus, in the handle part 6 or in a part 24 of the handle 4 adjacent to the upper front end of the trigger guard 10.

The energy supply 22 and the control device can be basically arranged at any place in the firearm 2, for example, where respective space is available (anyway) or where respective space can be provided by a corresponding design of the handle 4. The control device is preferably arranged at the smallest (possible) distance from the safety apparatus, for example, to minimize the effort to connect the control device and the safety apparatus. This can also apply to the energy supply 22. However, the aspects of the weight distribution in the firearm 2 can also be relevant for the arrangement of the energy supply 22 and/or of the control device, wherein an arrangement in the handle part 6 can be advantageous, for example.

In place of an energy supply 22 integrated in the firearm 2, an external energy supply (not shown) can be used (in addition or as option), which external energy supply can be adapted to, for example, transmit energy to the safety apparatus by means of capacitive and/or inductive coupling. Such an external energy supply can be attached to the hand or arm of the user of the weapon, for example. Such embodiments can increase safety in so far as only the presence of an external energy supply can enable a use of the firearm, namely when only the external energy supply or the external energy supply together with an energy supply 22 integrated in the firearm 2 allows an operation of the safety apparatus.

FIG. 3 shows schematical illustrations of an embodiment of a safety apparatus where, upon actuation of the trigger, the release/locking device is initially changed into a first state for a shot release and then, depending on whether or not there is an authorization to use a firearm, the release/locking device is kept in the first state or changed into a second state, which prevents a shot release or does prevent a shot release.

The safety apparatus comprises an release/locking device, which is referred to by 26 on the whole and which includes a firing pin 28, a transmission element 30 and a stop 32. The firing pin 28 can be moved in directions according to arrow 34 (in the longitudinal direction) to fire a cartridge disposed in the cartridge chamber 20. For an engagement with ammunition disposed in the cartridge chamber 20, the firing pin 28 has a striker pin or igniter 38, which extends away from its main body 36 in the longitudinal direction. In addition, the firing pin 28 can be rotated about its longitudinal axis, as indicated by arrow 40. Rotary motions of the firing pin 28 can be effected by forces and/or momentums acting on or lugs 42 and 44, which are formed on the main body 32. According to the illustration, the firing pin 28 has two ridges 42 and 44. In further embodiments, only one ridge or three or more ridges can be used to rotate the firing pin 28. In place of a structure, which extends away from the main body 36 and serves for receiving forces and/or momentums effecting rotations of the firing pin 28, the main body 36 can have one or more recesses, with which elements effecting rotations can engage.

Figure 11B:
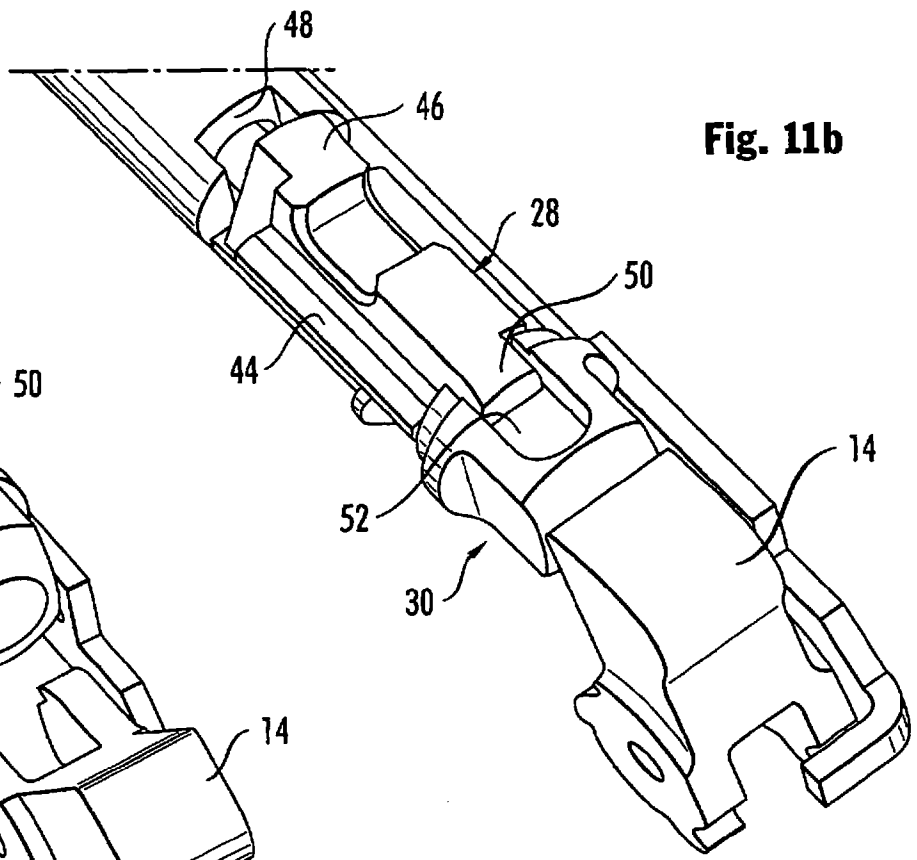
Figure 11A:
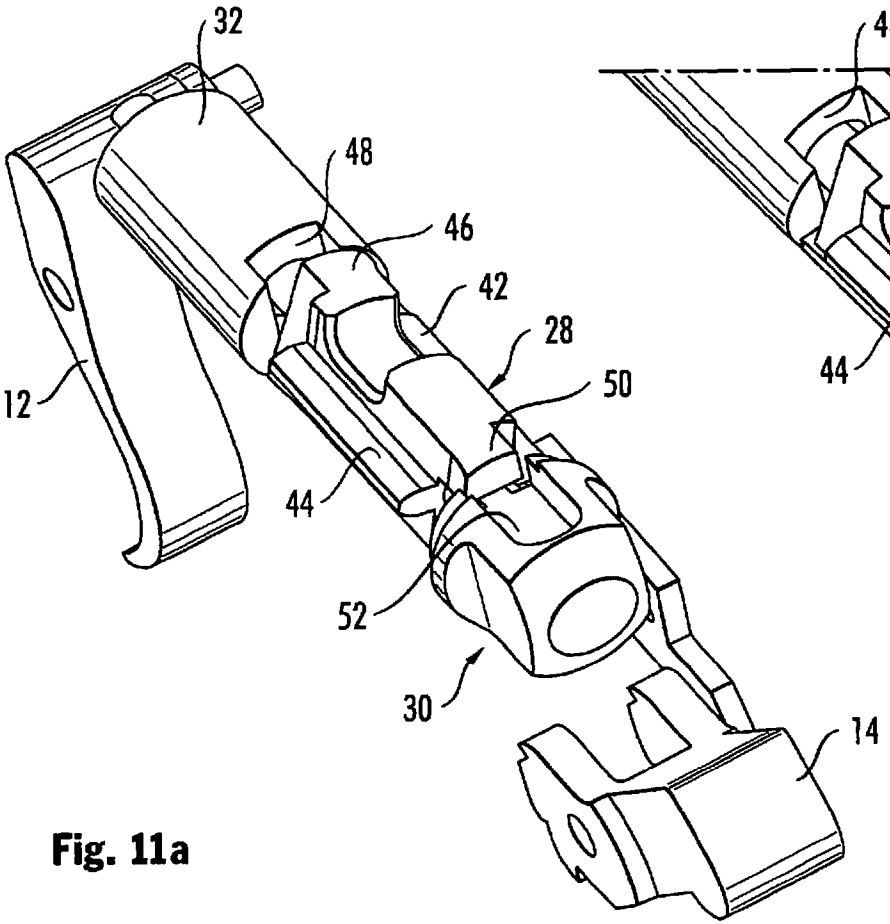
Figure 14B:
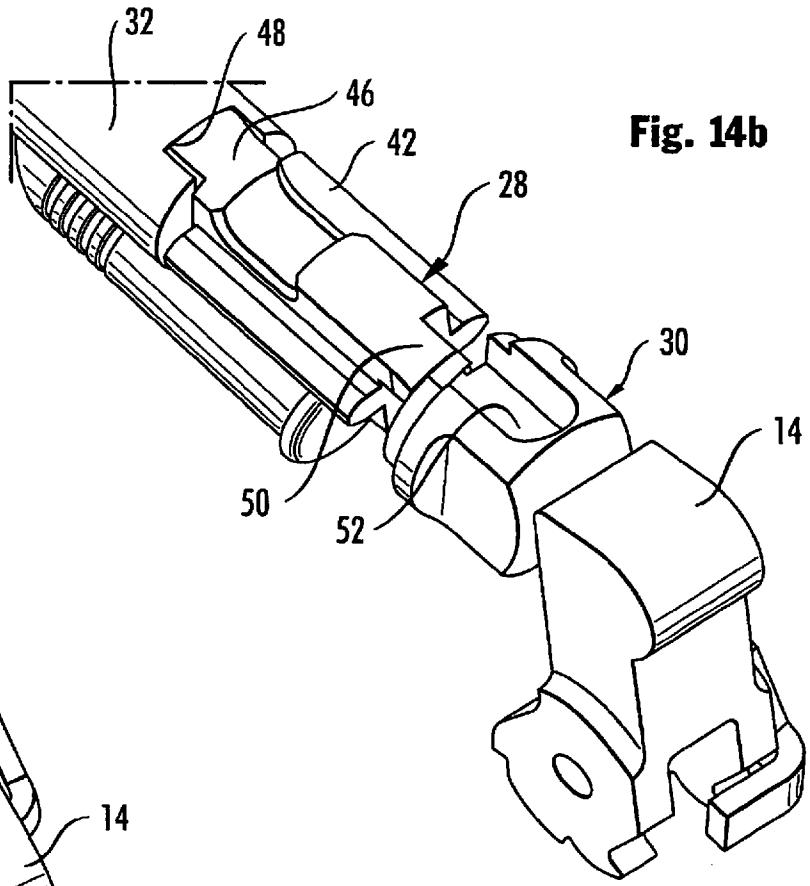
Figure 14A:
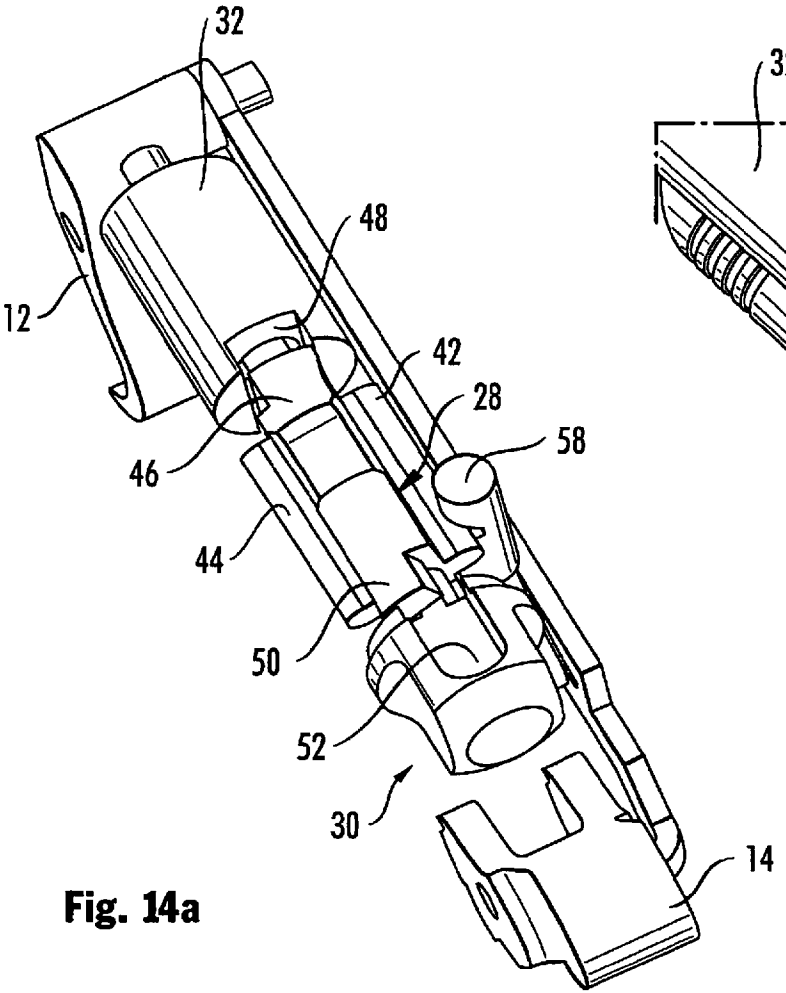

At its end adjacent to the stop 32, the main body 36 has a first form closure structure 46. When the firing pin 28 is positioned correspondingly, the first form closure structure 46 can be inserted in a complementarily shaped recess 48 in the stop 32; this is shown in FIGS. 14*a* and 14*b*, for example. When the firing pin 28 is positioned in such a way, it can be moved in the longitudinal direction to allow a shot to be fired and to cooperate with ammunition disposed in the cartridge chamber 20. When the firing pin 28 is not positioned or rotated such that the first form closure structure 46 can be inserted in the recess 48, the cooperation of the first form closure structure 46 and of the stop 32 prevents a movement of the firing pin 28 such that the igniter 38 cannot enter into engagement with the ammunition in the cartridge chamber 20. This is illustrated in FIGS. 11*a* and 11*b*, for example.

A movement of the firing pin 28 in the longitudinal direction, for a shot release, is effected by the hammer 14 when it actuates the firing pin 28. The illustrated embodiments use the transmission element 30, via which the firing pin 28 can be actuated (indirectly). In further variants, the transmission element 30 may be not used, wherein the hammer 14 can then cooperate directly with the firing pin 28. At its end adjacent to the transmission element 30, the main body 36 of the firing pin 28 has a second form closure structure 50.

In the position of the firing pin 28, in which the first form closure structure 46 cooperates, or can cooperate, with the stop 32 and prevents, or at least limits, movements of the firing pin 28 in its longitudinal direction, the second form closure structure 50 can engage a recess 52 provided at the transmission element 30. In this position, relative movements between transmission element 30 and firing pin 28 are possible. In the position of the firing pin 28, in which the first form closure structure 46 can engage the recess 48, the second form closure structure 50 and the transmission element 32 are opposite to each other such that the second form closure structure 50 cannot engage the recess 52.

Further, an actuation device 54, which has a control element 56 and an actuation element 58, is shown. The control element 56 and the actuation element 58 provide a cam mechanism or cam gear, wherein the actuation element 58 acts as driving member and the control element 56 acts as driven member. The control element 56 is in engagement with a link motion 60, e.g. by means of a pin 62 formed at the control element 56. As shown, the link motion 60 can be integrally formed with a trigger bar 64 of the weapon 2. In further variants, the link motion 60 can be provided as a separate component adapted to be subsequently arranged at the trigger bar 64, e.g. when the weapon is assembled. Indirect engagements are also possible.

The safety apparatus also comprises a state maintaining device 66 having an electromagnet 68 and a holding element 70, which is in engagement with the firing pin 28. The holding element 70 can be supported in a floating manner in an optional guide 72 by means of a spring 74. This support can compensate for manufacturing tolerances and e.g. changes caused by wear or abrasion. A floating support can (also) be achieved by positioning the electromagnet 68 in a biasing manner by means of a spring 76 (according to the illustrations of FIGS. 3*a* and 3*b* upwards) towards the guide 72. In such embodiments, the electromagnet 68 can engage the opposite surface 78 of the guide 72 and can thus hold the holding element 70 in a desired position, as described below.

Figure 4:
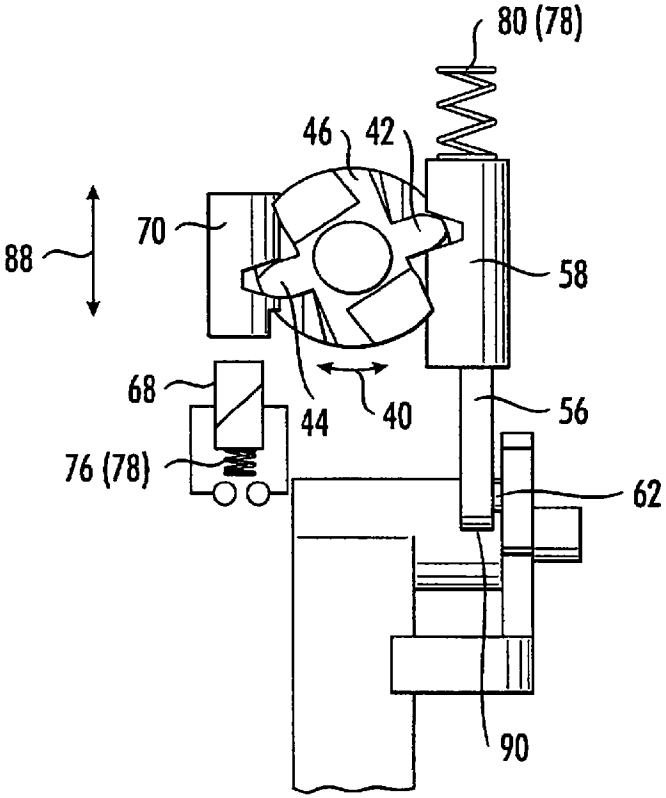

FIG. 4 shows an embodiment having a state maintaining device 66, wherein the holding element 70 is used without guide 72 and the electromagnet cooperating with a spring 76 is arranged in a biased fashion towards the holding element 70. In such an embodiment, the electromagnet 68 can directly engage the holding element 70 and hold it in a desired position.

In further variants, the state maintaining device 66 can comprise at least one component adapted to adopt two defined states, such as a bistable element, a piezoelectric actuator, a pawl or hook, magnetic components having a changeable magnetic polarization and/or an element adapted to be magnetized and demagnetized. In the states adapted to be adopted by the state maintaining device 66, one is provided to maintain the firing pin 28 in a desired position whereas the other state of the state maintaining device 66 enables a movement of the firing pin 28 and/or does not fix it in a position.

The safety apparatus also comprises a state changing device 78, which comprises a spring 80 that is in engagement with the actuation device 54, in particular cooperates with the actuation element 58. A task of the state changing device 78 is to move the firing pin 28 out of the position, in which it can be maintained by the state maintaining device 66, in particular such that the firing pin 28 adopts another predefined position. In further embodiments, the state changing device 78 can comprise any components, by which it is possible to produce forces and/or momentums adapted to act on the firing pin 28 directly (i.e. in direct engagement with the firing pin 28) or indirectly (e.g. via the state maintaining device 66). Examples are here bimetals, magnetic actuators, motor-driven actuators, piezoelectric actuators, elements where the magnetic poles can be reversed, and the like. In an also provided variant, the holding and state changing devices can be integrally formed, wherein the firing pin 28 can be held in a predefined position and/or can be brought out of it, e.g. by means of an element producing forces and/or momentums.

The state changing device 78 can comprise the spring 74 and/or the spring 76—in addition or alternative to spring 80. In such embodiments, spring 74 and/or spring 76 also serve(s) for resetting the firing pin 28, along with the floating support in the state maintaining device.

The actuation element 58 has a recess 82 cooperating with the ridge 42. The holding element 66 has a recess 84, which is in engagement with the ridge 46. As a result of the movements of the actuation element 58, as indicated by arrow 86, and the movements of the holding element 70, as indicated by arrow 88, the firing pin 28 can be held in rotating and positioned fashion. According to the drawings, it is provided that an upward movement of the actuation element 58 in FIG. 3*b* can effect a counterclockwise rotation of the firing pin 28 and an upward movement of the holding element 70 in FIG. 3*b* can effect a clockwise rotation of the firing pin 28. It is also provided that a counterclockwise rotation of the firing pin 28 results in a downward movement of the holding element 70 in FIG. 3*b*, while a clockwise rotation of the firing pin 28 moves the actuation element 58 according to the diagram of FIG. 3*b* downwards.

According to the illustration, upward movements of the actuation element 58 are achieved by means of a cam contour 90 formed on the control element 56, which contour can engage the end 92 of the actuation element 58, which is in the lower part according to the illustration. In the shown embodiments, the control element 56 and/or the cam contour 98 is not always in engagement with the actuation element 58. It is rather provided that such an engagement is substantially available when the actuation element 58 shall be moved by means of the control element 56.

With reference to FIGS. 5, 6, 7 and 8 as well as 14, states and courses are now described adapted to be provided for the embodiments as shown, irrespective of whether or not a user of the firearm 2 is authorized to use it, i.e. is allowed to fire a shot with it or not.

Figure 5B:
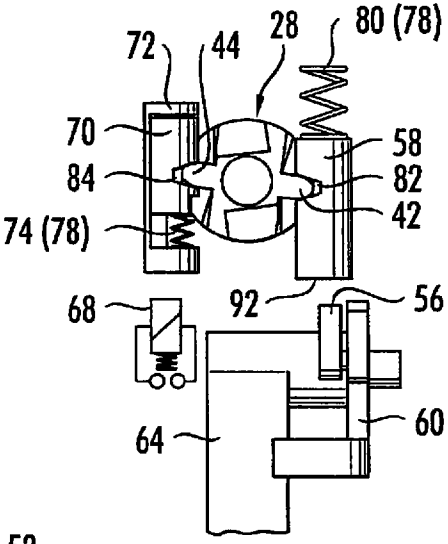
Figure 5A:
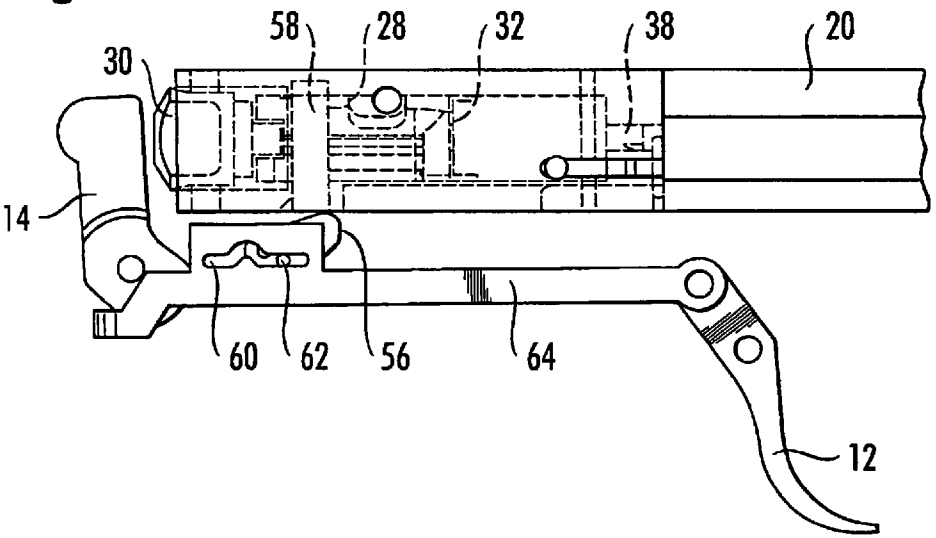
Figure 5C:
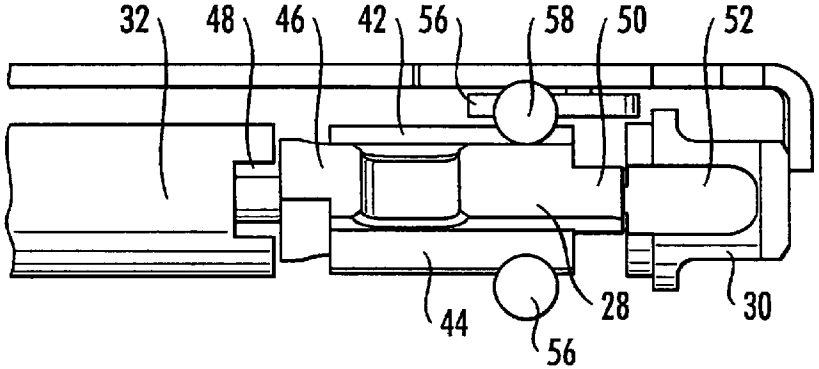
Figure 6:
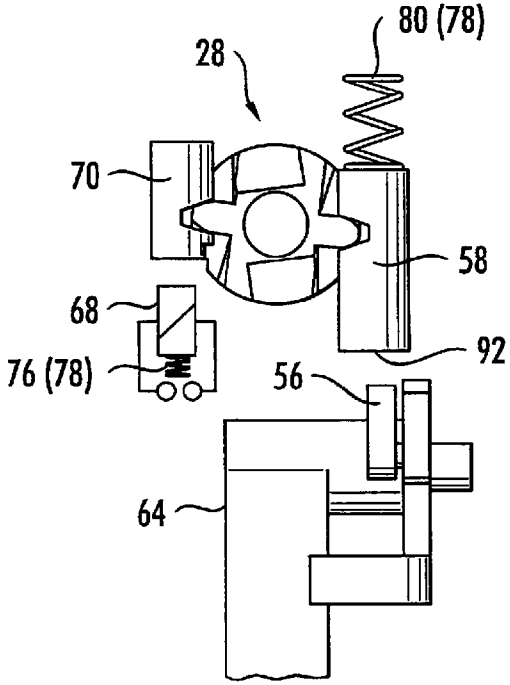

FIGS. 5 and 6 show a state of the safety apparatus and components of the firearm 2, that cooperate therewith before the trigger 12 is actuated. In this state, the release/locking device is a so-called first state, in which the firearm 2 is locked, i.e. no shot can be fired. In the first state of the release/locking device, the firing pin 28 has a first position, in which it cannot be moved in the longitudinal direction or cannot be moved to such an extent that a shot can be fired.

In the first position of the firing pin 28, the latter is positioned such that the first form closure structure 46 cannot be inserted in the recess 48, but that movements of the firing pin 28 in the longitudinal direction are prevented by an engagement of the first form closure structure 46 and the stop 32. In the first position, the first form closure structure 46 can be spaced from the stop 32, as shown. Although this allows minor movements of the firing pin 28 in the longitudinal direction, it prevents the firing pin 28 from moving to such an extent that a shot can be fired. In further embodiments, the first form closure structure 46 and the stop 32 contact, and therefore the firing pin 28 substantially cannot be moved in the longitudinal direction. In the first position of the firing pin 28, its second form closure structure 50 is positioned in such an alignment that it can be inserted in the recess 52 of the transmission element 30. It is thus possible to move the transmission element 30 towards the main body 36 of the firing pin 28 so that the second form closure structure 50 can at least partially be inserted in the recess 52 of the transmission element 30. In this first state of the release/locking device and/or this first position of the firing pin 28, it is thus not possible to fire a shot when forces act on the firing pin 28, e.g., when the firearm 2 is dropped or, when in the case of an misuse of the firearm 2, external forces are exerted on the transmission element 30 or the hammer 14.

In the first state of the release/locking device, the actuation element 58 and the holding element 70 are held (biased) by the spring(s) 74/76/80 in the positions as shown. In addition, there is no engagement between the actuation element 58 and the control element 56 in the first state of the release/locking device.

Figure 7B:
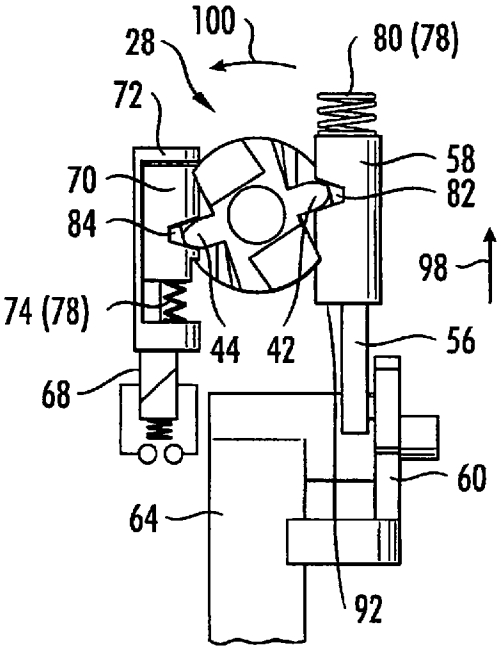
Figure 7A:
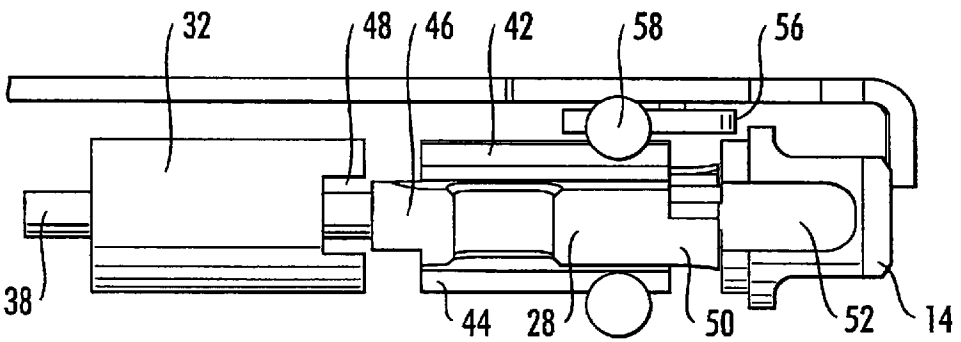
Figure 7C:
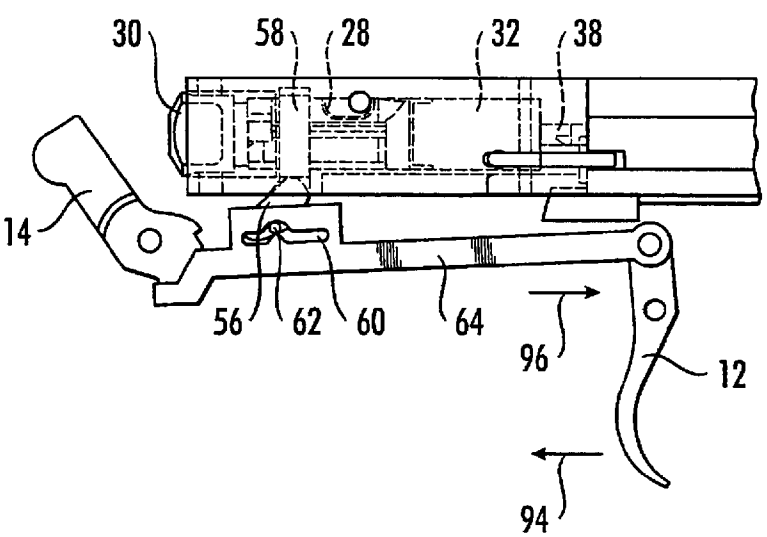
Figure 8:
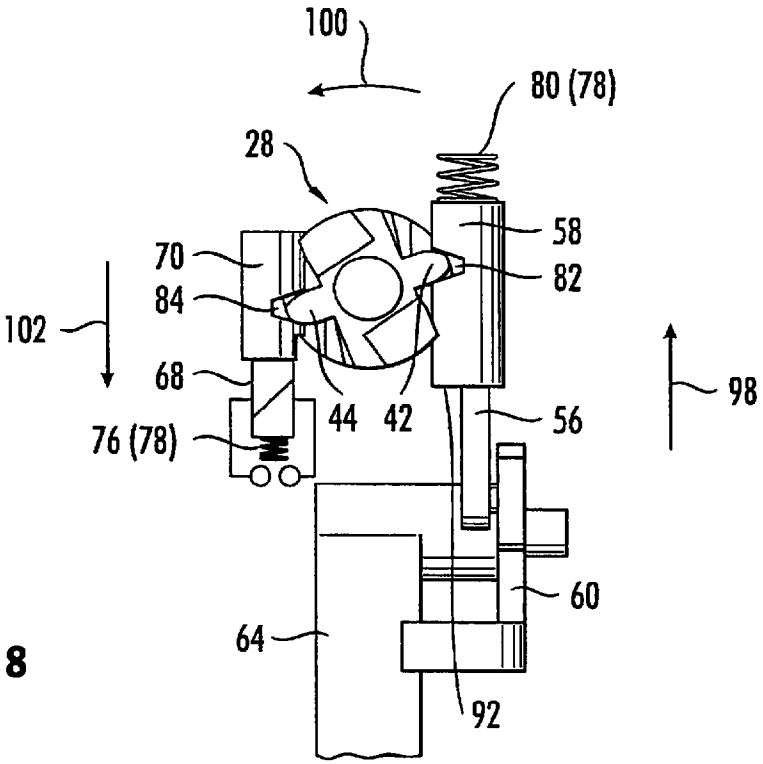

When, as shown in FIG. 7, the trigger 12 is actuated, the trigger bar 64 is moved. This is indicated in FIG. 7*a* by arrows 94 and 96. The movement of the trigger bar 64 effects, by means of the link motion 60 and the pin 62 guided therein, a movement of the control element 56 such that it enters into engagement with the actuation element 58 and moves it upwards against the force of the spring(s) 74/76/80 as shown in the diagram. The movement of the actuation element 58, in turn, effects a counterclockwise rotation of the firing pin 28, wherein the engagement between the firing pin 28 and the holding element 70 moves it downwards according to FIGS. 7*a* and 7*b* and FIG. 8. This is indicated in FIGS. 7*b* and 8 by arrows 98, 100 and 102.

These motion sequences effect that the firing pin 28 is changed into a second position, in which the first form closure structure 46 is positioned in alignment with the recess 48 and thus can be inserted therein. Movements of the firing pin 28 in the longitudinal direction are thus possible. In addition, the second form closure structure 50 is here positioned relative to the transmission element 30 such that the second form closure structure 50 cannot engage the recess 52 of the transmission element 30. This is also illustrated in FIGS. 14*a* and 14*b*. Movements of the transmission element 30 in the longitudinal direction result in a movement of the firing pin 28 in the longitudinal direction due to the engagement between the transmission element 30 and the second form closure structure 50 (wherein the engagement exists or can be established by the movement of the transmission element 30). This second state of the release/locking device and/or this second position of the firing pin 28 would basically enable a shot to be fired by a movement of the firing pin 28 in the longitudinal direction. When the weapon is used according to the rules, this is not (yet) the case because the hammer 14 is in its cocked position (see FIG. 7*a*, for example).

The period of time, in which the trigger bar 64 carries out, on account of the actuation of the trigger 12, a movement effecting that the release/locking device adopts the second state and the firing pin 28 adopts the second position, covers the first time period mentioned above.

The first time period is followed (directly or at a distance of time) by a second time period. The further states and courses now depend on whether there is authorization information (hereinafter in the exemplary form of an authorization signal specifying that the weapon can be used to fire a shot. In order to evaluate whether or not such an authorization is available, a control device accommodated in the weapon can be used, which control device in the case of an authorization generates an authorization signal while no authorization signal is produced without an authorization. Information on an authorization to use a weapon can be provided by means of a user-wearable transponder, radio sender, finger print sensor provided at the weapon, and the like.

The authorization can basically be evaluated at any time. However, since the decision of whether or not an actuation of the trigger 12 may actually lead to the firing of a shot is made when the release/locking device 26 is in its second state, the evaluation of the authorization can only be carried out shortly beforehand. This has, e.g., the advantage that the authorization can only be checked very shortly before the hammer 14 is triggered. Thus, if the authorization is no longer available in the period between the initial actuation of the trigger 12 and the time, at which the release/locking device 26 adopts its second state, the firing of a shot is prevented.

Figure 9B:
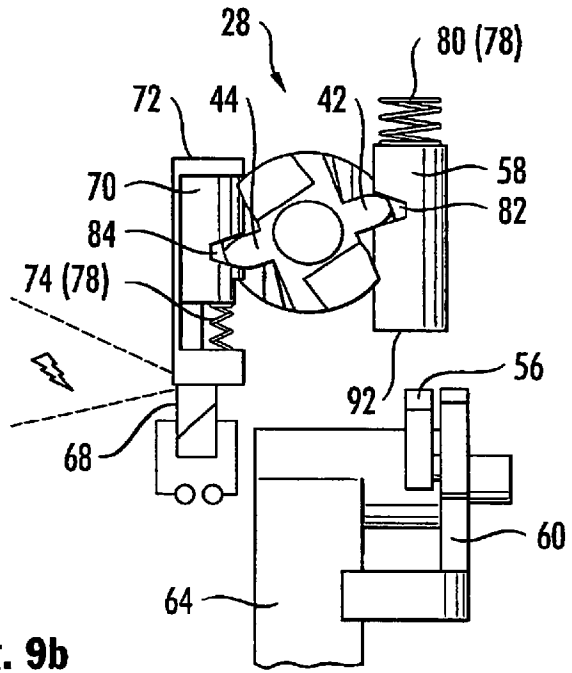
Figure 9A:
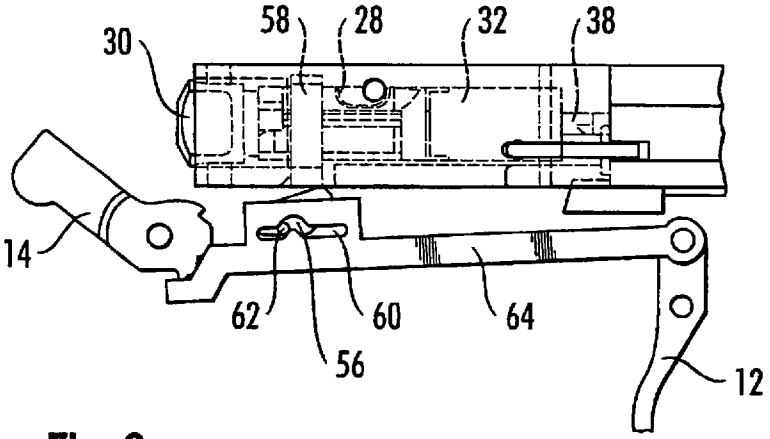
Figure 10:
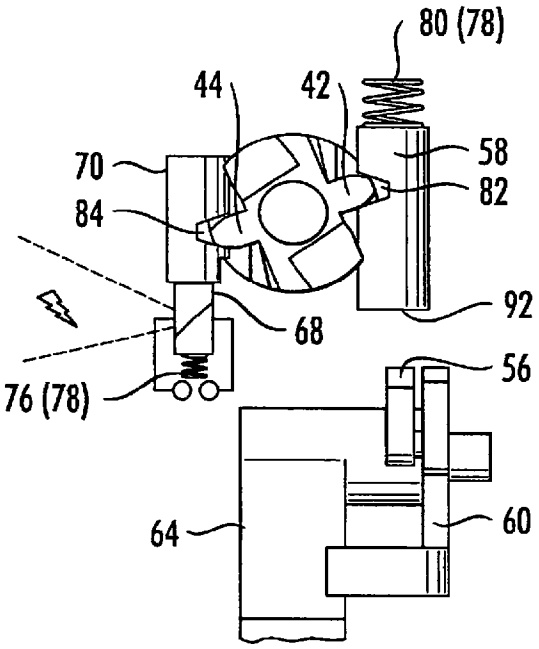

In the case of an authorization to use the firearm 2, reference is now made to FIGS. 9, 10 and 11. When an authorization is present and the authorization signal is produced, the electromagnet 68 is energized to generate a magnetic field, which holds the holding element 70 in the position shown in FIGS. 9*b* and 10. The firing pin 28 is thus also kept in its second position. This can be referred to as an "unlocked" operating state of the firearm 2.

The movements of the trigger bar 64, which occur in this connection, result, by means of the link motion 60, to a movement of the control element 56, which movement leads away from the actuation element 58. The actuation element 58 is held in the position shown in the lower diagram of FIG. 6 by the firing pin 28, which is held in its second position. The movement of the trigger bar 60 can also result in a further biasing of the hammer 14. When the hammer 14 is triggered and forced against the transmission element 30, it and, on account of its engagement with the firing pin 28, the pin are also moved in a longitudinal direction. This results in a cooperation of the igniter 38 with a cartridge disposed in the cartridge chamber 20, and the cartridge is fired.

Then, the firing pin 28 and the transmission element 30 as well as the hammer 14, trigger bar 64 and trigger 12 return to their initial positions. It is pointed out that the state maintaining device 66 may only be activated until the first form closure structure 46 is inserted in the recess 48 (at least) to such an extent that a longitudinal movement of the firing pin 28 cannot be prevented any more. However, it is also possible to maintain the state maintaining device 66 activated for a prolonged period of time, e.g. until one, several or all elements comprising firing pin 28, transmission element 30, hammer 14, trigger bar 64 and trigger 12 have returned to their initial positions. In both cases, compared to known approaches, the state maintaining device 66 is only activated for a short time and therefore the energy demand required for the activation can be minimized. As a result, it is also possible to use an energy supply 22 having a comparatively small size/capacity.

Figure 12B:
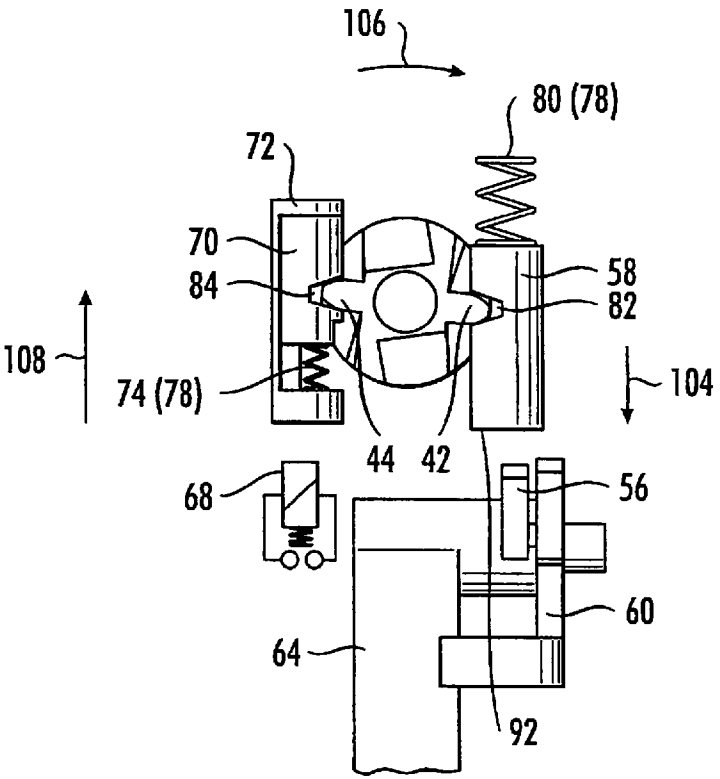
Figure 12A:
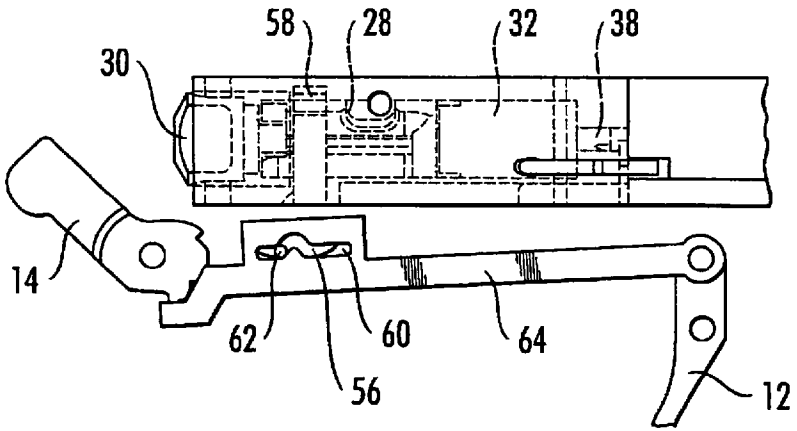
Figure 13:
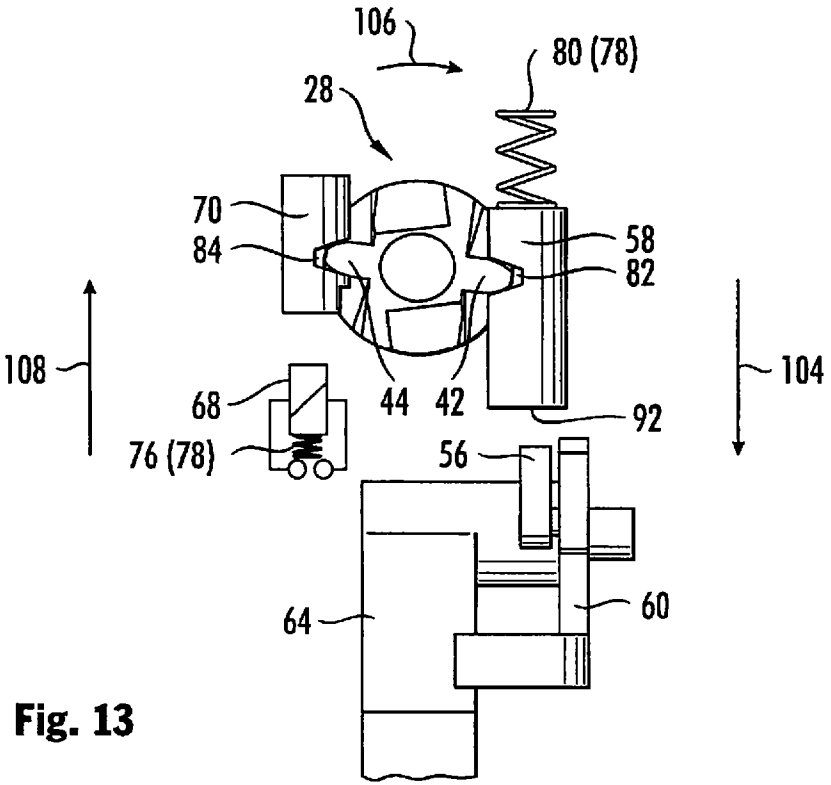

For cases without authorization to use the firearm 2, reference is now made to FIGS. 12, 13 and 14. If no authorization is present and no authorization signal is produced, the state maintaining device 66 is not activated and/or the electromagnet 64 is not energized. As already described, the movement of the trigger bar 64 now effects a movement of the control element 56 away from the actuation element 58. This makes it possible that the spring(s) 72/74/80 move the actuation element 58 according to FIGS. 12*b* and 13 downwards. This movement of the actuation element 58 returns the firing pin into its first position and thus changes the release/locking device into its first state again. Here, the holding element 70 is also moved upwards again. This is indicated in FIGS. 12*b* and 13 by arrows 104, 106 and 108. In this "locked" state of the firearm, the firing pin 28 cannot be moved to fire a shot, as explained above. When the hammer 14 is triggered and strikes the transmission element 30, it is moved towards the main body 36 of the firing pin 28 and the second form closure structure 50 is (partially) inserted in recess 52. The force exerted by the hammer 14 thus only moves the transmission element 30, but does not lead to a movement of the firing pin 28 to fire a shot or does not lead to a movement where a shot is not fired. This is also illustrated in FIGS. 14*a* and 14*b*. By a corresponding design of the second form closure structure 50 and/or the recess 52, it is possible to prevent, or at least partially minimize, a force of the hammer 14 from acting on the firing pin 28. Preferably, the transmission element 30 is at least partially made of a resiliently deformable material adapted to absorb forces generated by the hammer 14. Then, the hammer 14, the trigger bar 64 and/or trigger 12 return to their initial positions. The release/locking device 26, the actuation device 54 and the state maintaining device 66 can have already adopted their initial positions due to the lacking authorization signal, e.g. before the hammer 14 strikes the transmission element 30.

The time passing until the hammer 14 strikes the transmission element 30 covers the above second time period for both the "unlocked" and "locked" operating states of the weapon. A third time period may follow where the hammer 14, the trigger bar 64 and the trigger 12 return to their initial positions. Depending on whether or not there is an authorization signal, the components of the safety apparatus can also adopt their initial positions in the third time period or already in the second time period.

Figure 15:
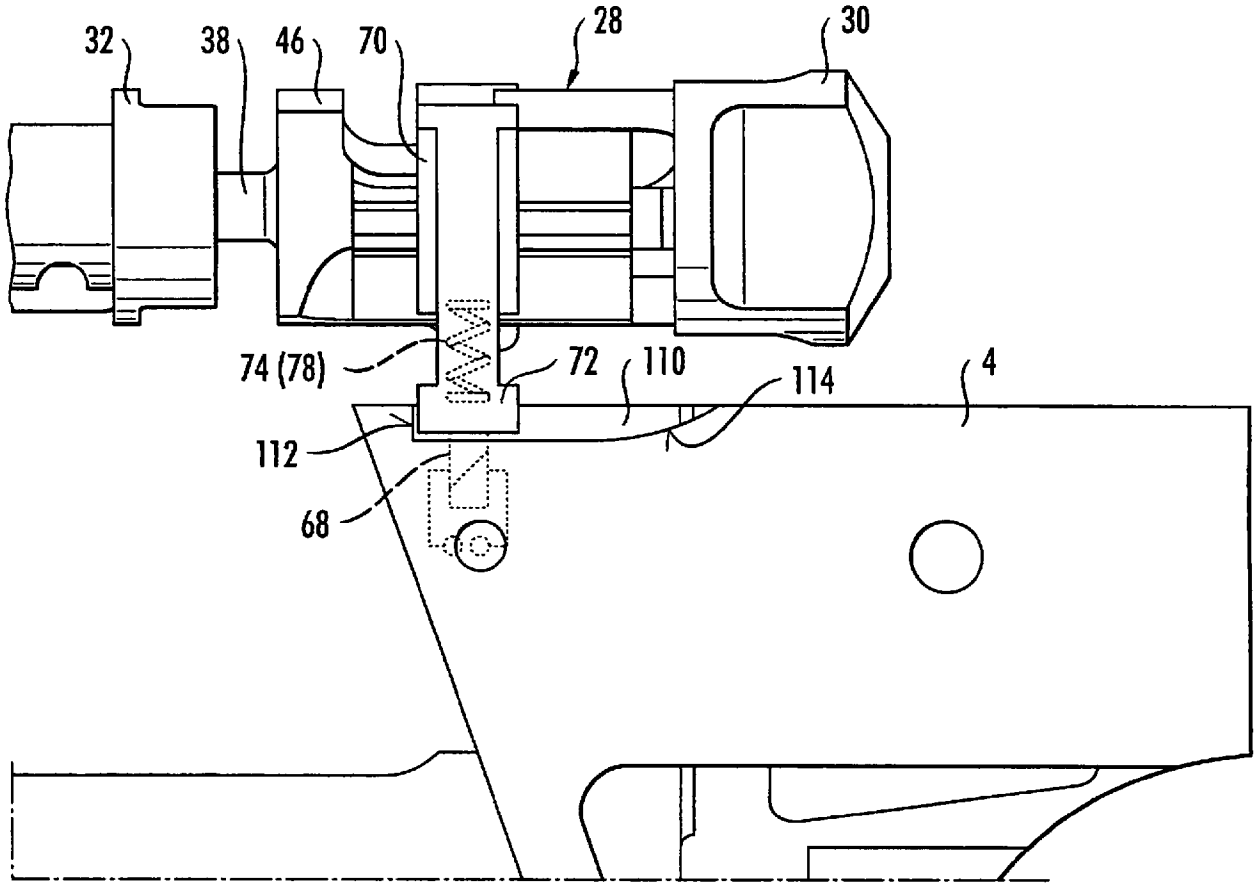
FIGS. 15 and 16 show schematic partial views of a further design of the safety apparatus.
Figure 16:
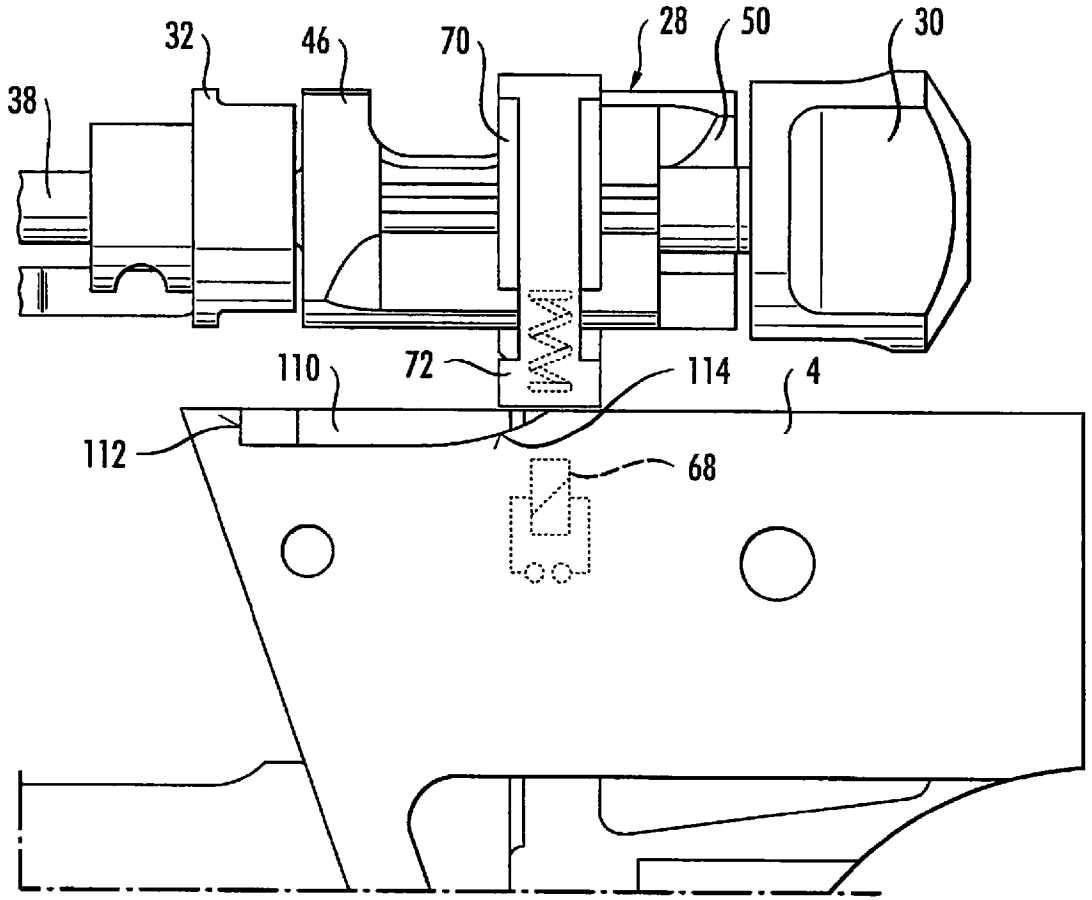

FIGS. 15 and 16 show a further embodiment of a state changing device. This variant can also be referred to as a force-controlled state changing device because here the reset of the safety apparatus and in particular of the state maintaining device 66 is (automatically) also effected by movements in the firearm 2 after firing a shot. In the variant as shown, a state maintaining device 66 is used, in which the holding element 70 is guided in the guide 72 and is supported by means of spring 74 (see e.g. FIGS. 5*b*, 7*b*, 9*b*). In place of such a state maintaining device 66, it is also possible to use a state maintaining device 66 where the holding element 70 can cooperate without guide 72 directly with the electromagnet 68 and the electromagnet 68 is supported by means of spring 76.

In the handle 14, a recess 110 is formed, with which the illustrated lower end of the guide 72 of the holding element 70 can engage. FIG. 15 shows an "unlocked" state of the firearm 2 before a shot is fired, wherein the state maintaining device 66 maintains the firing pin 28 in the position corresponding for this purpose. In particular, the holding element 70 is held via its guide 72 by the electromagnet 76 in the position, which is in the lower part according to the drawing, as is also the case in FIG. 7*b*. In this state, as shown, the lower end of the guide 72 can be arranged at the left-hand end of the recess 110, where an abutment surface 112 can be provided as movement limitation.

After a shot is fired, the firing pin 28 moves to the right according to the drawing. Here, the firing bolt 28 takes along the state maintaining device 66, in particular by the engagement with the holding element 70. As a result, the guide 72 is also moved to the left according to the diagram and is separated from the electromagnet by a guide surface 114 of the recess 110. This is illustrated in FIG. 16. This movement of the guide 72, which is supported by the force of spring 74, where appropriate, moves the holding element 70 in such a way (upwards according to the diagram) that the firing pin 28 is moved (back) into its initial position. The safety apparatus returns to its first state and the firearm 2 is locked.

When a state maintaining device 66 is used without a guide 72, the lower end of the holding element 70, which is opposite to the electromagnet 68, can engage recess 110 and can be guided therein, in particular by the guide surface 114.

In further embodiments, a force-controlled reset (in addition or as alternative to the above embodiment) can be made by means of the actuation device 54 and in particular by means of the actuation element 58. In such variants, it is provided, for example, that the actuation element 58 can cooperate with the recess 110 and its guide surface 114 or a similarly acting guide structure, as described above for the holding element 70 and/or its guide 72. It is also possible to use as a guide structure instead of a recess a structure protruding (from handle 4, for example) e.g. in the form of a protruding radial cam surface. Combinations of recesses and protruding shapes are also possible as a guide structure.

Also such force-controlled embodiments, the embodiments of the state changing device 66, which are described above with reference to FIGS. 3 to 14, can be used, for example, to provide an additional reset, which supports the force-controlled reset and/or effects a reset when the force-controlled reset fails. It is also possible to provide a force-controlled reset as a supplement and/or safety of the embodiments of the state changing device 66, which are described above with reference to FIGS. 3 to 14.

In further embodiments of the safety apparatus, the release/locking device is changed, depending on whether or not an authorization to use a firearm is present, into a first state for a shot release or is kept in the second state, which prevents a shot release or does not allow a shot to be fired, when the trigger is actuated.

The now described safety apparatuses comprise a release/locking device, a state changing device and an actuation device as well as, in some embodiments, a state maintaining device. These devices can differ as regards their design and function from the above release/locking, state changing, actuation and state maintaining devices.

FIGS. 17 to 19 show schematic views of an embodiment of a safety apparatus, wherein, preferably upon actuation of the trigger, the release/locking device is initially kept in a first state, which prevents a shot release, and then, when the trigger is actuated depending on whether or not an authorization to use a firearm is present, the release/locking device is changed into a second state for a shot release or is kept in the first state.

The above observations also apply to this embodiment, unless otherwise specified. For the purpose of completeness, however, some explanations are repeated without this intending to be a limitation.

The safety apparatus comprises a release/locking device, which is referred to by 26 on the whole and which includes a firing pin 28, a transmission element 30 and a stop 32. The firing pin 28 can be moved in directions according to arrow 34 (in the longitudinal direction) to fire a cartridge disposed in the cartridge chamber 20. For an engagement with ammunition disposed in the cartridge chamber 20, the firing pin 28 has a striker pin or igniter 38, which extends away from its main body 36 in the longitudinal direction. In addition, the firing pin 28 can be rotated about its longitudinal axis, as indicated by arrow 40. Rotary motions of the firing pin 28 can be effected by forces and/or momentums acting on ridges or lugs 42 and 44, which are formed on the main body 32. According to the diagram, the firing pin 28 has two ridges 42 and 44. In further embodiments, only one ridge or three or more ridges can be used to rotate the firing pin 28. In place of a structure, which extends away from the main body 36 and serves for receiving forces and/or momentums effecting rotations of the firing pin 28, the main body 36 can have one or more recesses, with which elements effecting rotations can engage.

At its end adjacent to the stop 32, the main body 36 has a first form closure structure 46. When the firing pin 28 is positioned correspondingly, the first form closure structure 46 can be inserted in a complementarily shaped recess 48 in the stop 32; this is shown in FIGS. 14*a* and 14*b*, for example. When the firing pin 28 is positioned in such a way, it can be moved in the longitudinal direction to allow a shot to be fired and to cooperate with ammunition disposed in the cartridge chamber 20. When the firing pin 28 is not positioned or rotated such that the first form closure structure 46 can be inserted in the recess 48, the cooperation of the first form closure structure 46 and of the stop 32 prevents a movement of the firing pin 28 such that the igniter 38 cannot enter into engagement with the ammunition in the cartridge chamber 20. This is illustrated in FIGS. 11*a* and 11*b*, for example.

A movement of the firing pin 28 in the longitudinal direction, for a shot release, is effected by the hammer 14 when it actuates the firing pin 28. The designs as shown use the transmission element 30, via which the firing pin 28 can be actuated (indirectly). In further variants, the transmission element 30 may be not used, wherein the hammer 14 can then cooperate directly with the firing pin 28. At its end adjacent to the transmission element 30, the main body 36 of the firing pin 28 has a second form closure structure 50.

G37

In the position of the firing pin 28, in which the first form closure structure 46 cooperates or can cooperate with the stop 32 and prevents, or at least limits, movements of the firing pin 28 in its longitudinal direction, the second form closure structure 50 can mesh engage a recess 52 provided at the transmission element 30. In this position, relative movements between transmission element 30 and firing pin 28 are possible. In the position of the firing pin 28, in which the first form closure structure 46 can engage the recess 48, the second form closure structure 50 and the transmission element 32 are opposite such that the second form closure structure 50 cannot mesh with the recess 52.

Further, an actuation device 54, which has a control element 56 and an actuation element 58, is shown. The actuation element 58 is supported in a guide 116 by means of a spring 118. In further embodiments, the actuation element 58 can be provided without the guide 116 and directly cooperate with the control element 56. The control element 56 and/or the guide 116 and the actuation element 58 provide a cam mechanism or cam gear, wherein the actuation element 58 and/or the guide 116 acts as driving member and the control element 56 acts as driven member. The control element 56 is in engagement with a link motion 60, e.g. by means of a pin 62 formed at the control element 56. As shown, the link motion 60 can be integrally formed with a trigger bar 64 of the weapon 2. In further variants, the link motion 60 can be provided as a separate component adapted to be subsequently arranged at the trigger bar 64, e.g. when the weapon is assembled. Indirect engagements are also possible.

The safety apparatus also comprises a state maintaining device 66 having an electromagnet 68 and a holding element 70, which is in engagement with the firing pin 28. A floating support of the electromagnet 68 is achieved by means of a spring 76, which supports in a biased manner the electromagnet 68 (downwards according to the diagrams) towards the holding element 70.

In further variants, the state maintaining device 66 can comprise at least one component adapted to adopt two defined states, such as a bistable element, a piezoelectric actuator, a pawl or hook, magnetic components having a changeable magnetic polarization and/or an element adapted to be magnetized and demagnetized. Of the states adapted to be adopted by the state maintaining device 66, one is provided to maintain the firing pin 28 in a desired position whereas the other state of the state maintaining device 66 enables a movement of the firing pin 28 and/or does not fix it in a position.

The safety apparatus also comprises a state changing device 78, which includes a spring 80 that is in engagement with the holding element 70. A task of the state changing device 78 is to move the firing pin 28 into the position, in which it can be maintained by the state maintaining device 66. In further embodiments, the state changing device 78 can comprise any components, by which it is possible to produce forces and/or momentums adapted to act on the firing pin 28 directly (i.e. in direct engagement with the firing pin 28) or indirectly (e.g. via the state maintaining device 66). Examples are here bimetals, magnetic actuators, motor-driven actuators, piezoelectric actuators, elements where the magnetic poles can be reversed, and the like. In an also provided variant, the holding and state changing devices can be integrally formed, wherein the firing pin 28 can be held in a predefined position and/or can be moved out of it, e.g. by means of an element producing forces and/or momentums.

The actuation element 58 has a recess 82 cooperating with the ridge 42. The holding element 66 has a recess 84, which is in engagement with the ridge 46. As a result of the movements of the actuation element 58, as indicated by arrow 86, and movements of the holding element 70, as indicated by arrow 88, the firing pin 28 can be held in rotating and positioned fashion. According to the drawings, it is provided that an upward movement of the actuation element 58 can effect a counterclockwise rotation of the firing pin 28 and an upward movement of the holding element 70 in FIG. 3*b* can effect a clockwise rotation of the firing pin 28. It is also provided that a counterclockwise rotation of the firing pin 28 results in a downward movement of the holding element 70 in FIG. 3*b*, while a clockwise rotation of the firing pin 28 moves the actuation element 58 downwards.

According to the illustration, upward movements of the actuation element 58 are achieved by means of a cam contour 90 formed on the control element 56, which contour can engage the end 120 of the guide 58, which is in the lower part according to the illustration (or directly with the lower end 92 of the actuation element 58). In the embodiments shown, the control element 56 and/or the cam contour 98 is not always in engagement with the actuation element 58. It is rather provided that such an engagement is substantially available when the actuation element 58 shall be moved by means of the control element 56.

States and courses are now described adapted to be provided for the embodiments as shown, irrespective of whether or not a user of the firearm 2 is authorized to use it, i.e. is allowed to fire a shot with it or not.

Figure 17B:
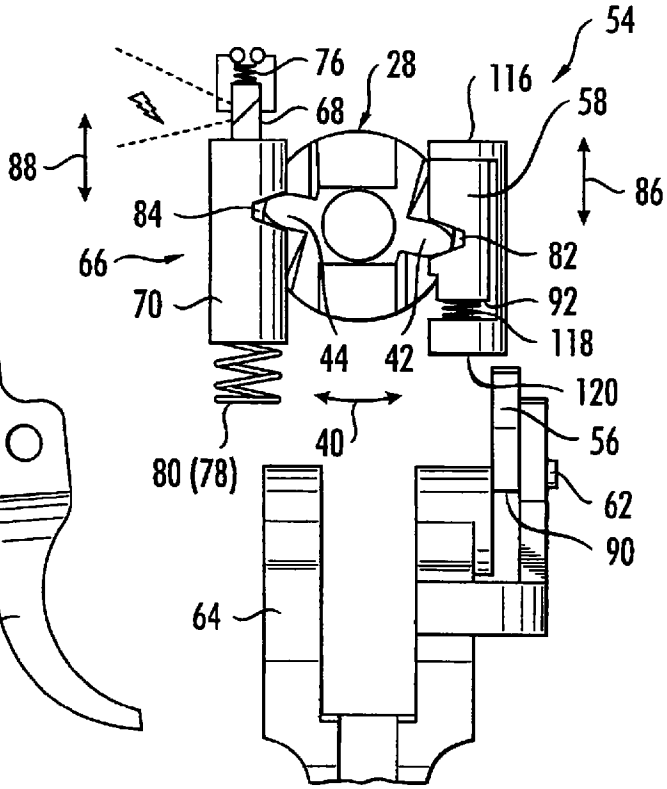
FIGS. 17*a* and 17*b* show diagrams of a further design of the safety apparatus according to the invention, which comprises the release/locking device in an initial state.
Figure 17A:
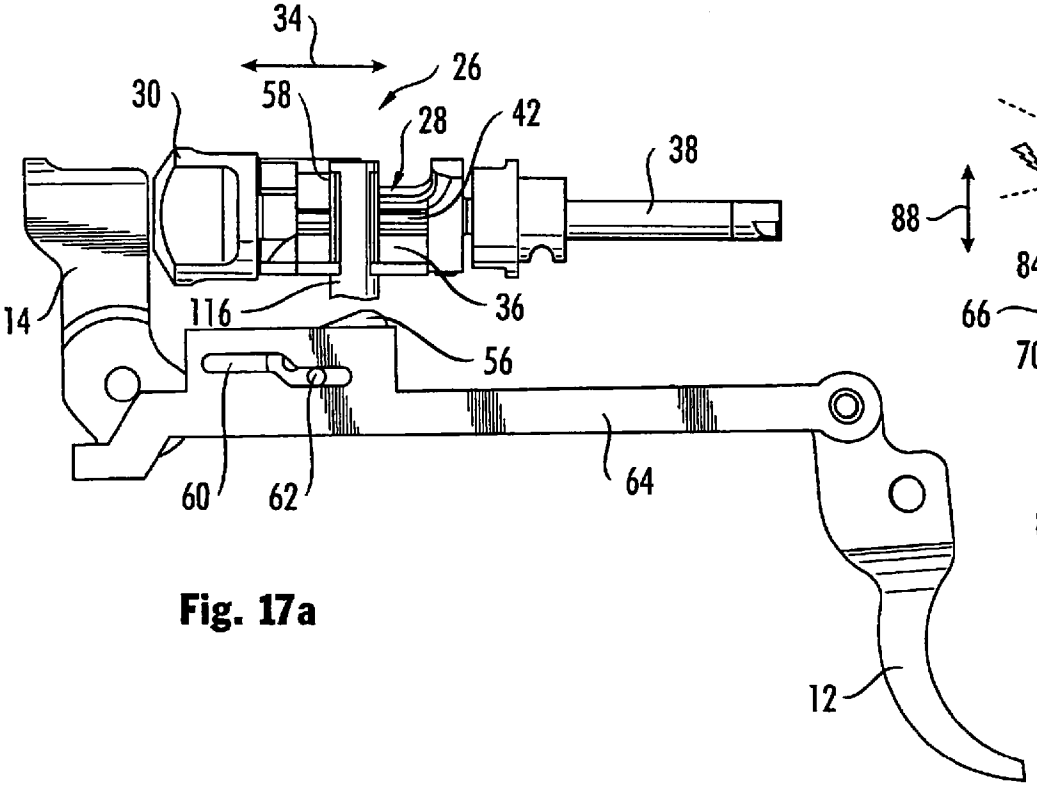

FIGS. 17*a* and 17*b* show a state of the safety apparatus and components of the firearm 2, which cooperate therewith before the trigger 12, is actuated. In this state, the release/locking device is in a so-called first state, in which the firearm 2 is locked, i.e. no shot can be fired. In the first state of the release/locking device, the firing pin 28 has a first position, in which it cannot be moved in the longitudinal direction or cannot be moved to such an extent that a shot can be fired.

In the first position of the firing pin 28, the latter is positioned such that the first form closure structure 46 cannot be inserted in the recess 48, but that movements of the firing pin 28 in the longitudinal direction are prevented by an engagement of the first form closure structure 46 and the stop 32. In the first position, the first form closure structure 46 can be spaced from the stop 32, as shown. Although this allows minor movements of the firing pin 28 in the longitudinal direction, it prevents the firing pin 28 from moving to such an extent that a shot can be fired. In further embodiments, the first form closure structure 46 and the stop 32 contact, and therefore the firing pin 28 substantially cannot be moved in the longitudinal direction. In the first position of the firing pin 28, its second form closure structure 50 is positioned in such an alignment that it can be inserted in the recess 52 of the transmission element 30. It is thus possible to move the transmission element 30 towards the main body 36 of the firing pin 28 so that the second form closure structure 50 can at least partially be inserted in the recess 52 of the transmission element 30. In this first state of the release/locking device and/or this first position of the firing pin 28, it is thus not possible to fire a shot when forces act on the firing pin 28, e.g. when the firearm 2 is dropped or when, in the case of an misuse of the firearm 2, external forces are exerted on the transmission element 30 or the hammer 14.

In the first state of the release/locking device, the actuation element 58 and the holding element 70 are held (biased) by the springs in the positions as shown. In addition, there is no engagement between the guide 116 and the control element 56 in the first state of the release/locking device.

These positions and in particular the position of the holding element 70 are secured because the electromagnet 68 secures the holding element 70 in the position as shown.

When the trigger 12 is actuated, the trigger bar 64 is moved. The movement of the trigger bar 64 effects, by means of the link motion 60 and the pin 62 guided therein, a movement of the control element 56 such that it enters into engagement with the guide 116 and moves it upwards as shown in the diagram.

Figure 18B:
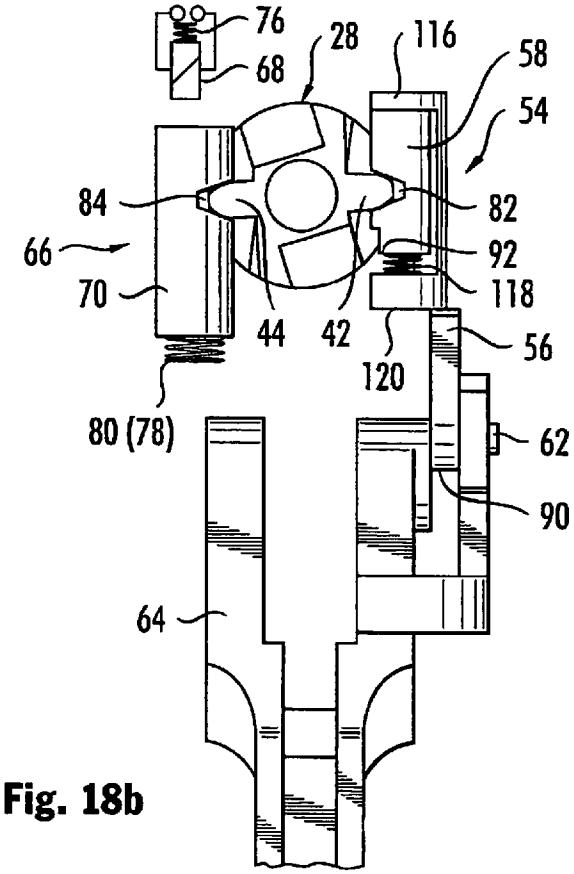
FIGS. 18*a* and 18*b* show diagrams of the safety apparatus of FIGS. 17*a* and 17*b*, which comprises the release/locking device in a state for a shot release when there is an authorization to use the firearm.
Figure 18A:
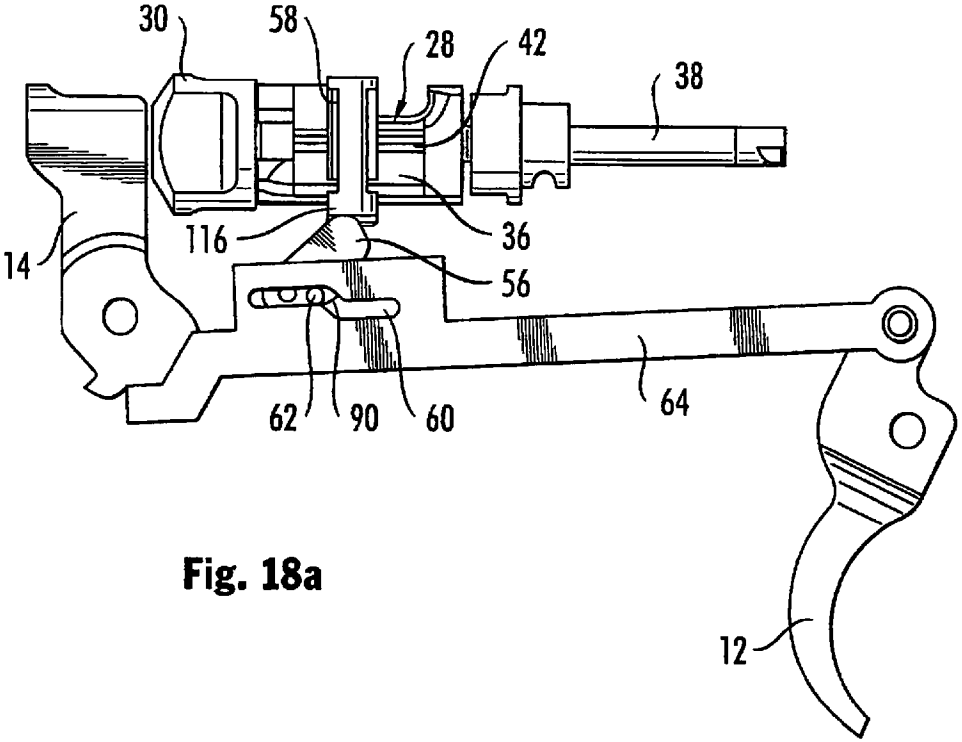

When there is an authorization to use the firearm, the electromagnet 68 is deactivated. This allows a downward movement of the holding element 70 according to the diagram. Since the holding element 70 is no longer held by the electromagnet 68, and thus the firing pin can be rotated counterclockwise, an upward movement of the actuation element 58 is also possible according to the illustration. Hence, the upward movement of the guide 116 can be transmitted to the actuation element 58 by spring 118, and the actuation element 58 moves upwards. The movement of the actuation element 58, in turn, effects a counterclockwise rotation of the firing pin 28, wherein the engagement between the firing pin 28 and the holding element 70 effects a downward movement. This is illustrated in FIGS. 18*a* and 18*b*. After a shot is fired, the state changing device 78, 80 brings the holding element 70 upwards again, and therefore the firing pin is returned into the position, in which no shot can be fired.

These motion sequences effect that the firing pin 28 is changed into a second position, in which the first form closure structure 46 is positioned in alignment with the recess 48 and thus can be inserted therein. Movements of the firing pin 28 in the longitudinal direction are thus possible. In addition, the second form closure structure 50 is here positioned relative to the transmission element 30 such that the second form closure structure 50 cannot engage the recess 52 of the transmission element 30. Movements of the transmission element 30 in the longitudinal direction result in a movement of the firing pin 28 in the longitudinal direction due to the engagement between the transmission element 30 and the second form closure structure 50 (wherein the engagement exists or can be established by the movement of the transmission element 30). This second state of the release/locking device and/or this second position of the firing pin 28 would basically enable a shot to be fired as a result of a movement of the firing pin 28 in the longitudinal direction.

Figure 19B:
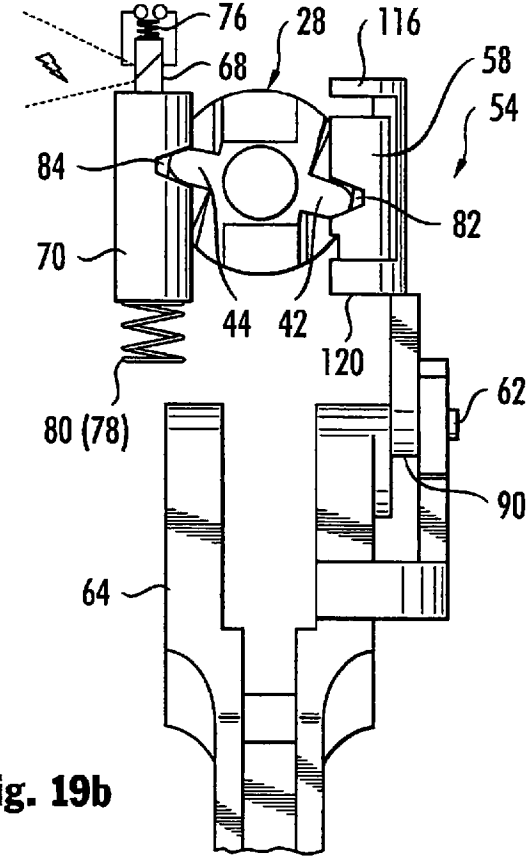
FIGS. 19*a* and 19*b* show diagrams of the safety apparatus of FIGS. 17*a* and 17*b* in a state, which prevents a shot, release when there is no authorization to use the firearm.
Figure 19A:
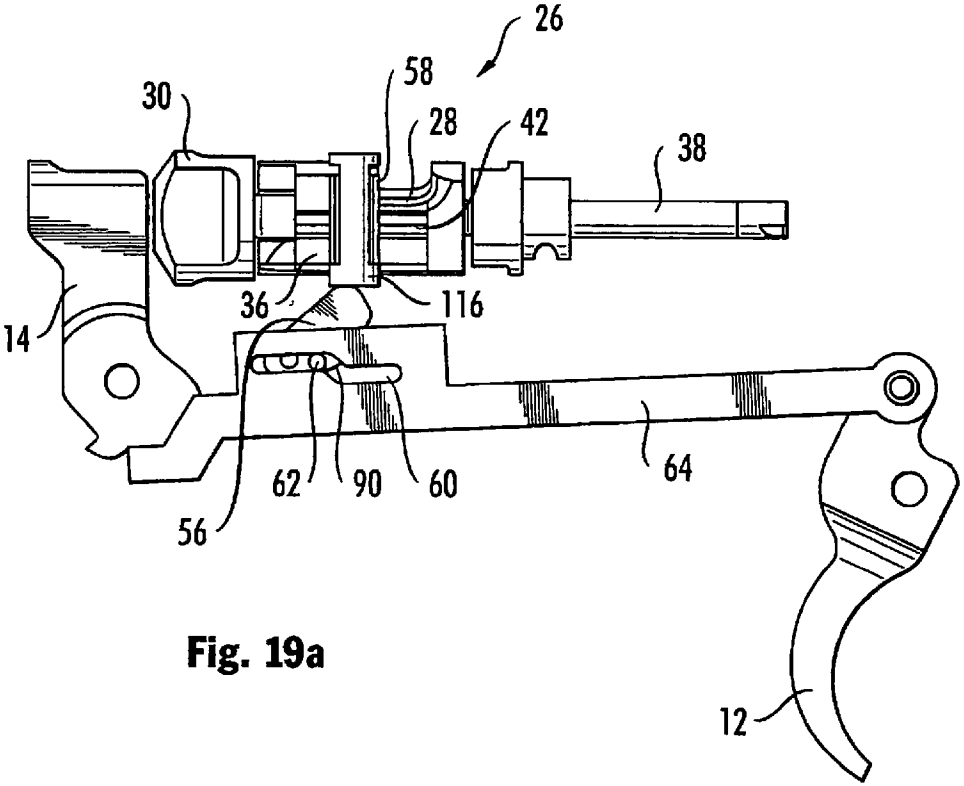

When there is no authorization to use the firearm, the electromagnet 68 remains activated. This prevents, according to the illustration, a downward movement of the holding element 70. Since the holding element 70 is continued to be held by the electromagnet 68 and thus the firing pin cannot be rotated, no movement of the actuation element 58 is possible. Hence, the upward movement of the guide 116 results in a compression of the spring 118, and the guide 116 moves relative to the actuation element 58, which is not moved as such. This is illustrated in FIGS. 19*a* and 19*b*.

In further embodiments and variants of the safety apparatus and also in the above described embodiments, it is intended to provide the control device with information on whether there is an authorization to handle the firearm. The control device per se can determine such information and/or receive it from an external device. In all cases, information on a handling authorization can also specify whether a person is authorized to use the firearm and in particular to fire a shot. Furthermore, it can (also) be stated whether a person authorized to handle/use the firearm belongs to a special circle. Examples of special circles are police, army or in particular groups of persons, for which the functioning of a firearm is to be ensured to a high degree, even if the safety apparatus and/or other firearm components, which cooperate therewith, do not function perfectly. For example, when there is a failure of the energy supply and/or the control device, it is possible that the firearm cannot be used, i.e. no shot can be fired. In order to indicate whether a person belongs to a certain circle, it can be evaluated whether an authorization assigned to the person belongs to a certain type or provides other information on whether the person belongs to a special circle. When the person who wants to use the firearm belongs, or does not belong, to the special circle, the control device is informed about this by means of an authorization type information, for example. When the person belongs to the special circle, the control device can effect that the firearm can fire a shot even if the safety apparatus and/or other firearm components, which cooperate therewith, do not function perfectly. A failsafe device can be used for this purpose. It is designed at least partially as a separate component and/or at least partially comprised by the control device or provided by the latter (e.g. functionally). The failsafe device can effect, for example, that in the case of a failure the release/locking device is changed into a state for a shot release, in which it is held, i.e. the first state according to the present description. Depending on the embodiment, this can be achieved by means of the state changing device or the state maintaining device. For this, it may be necessary to operate the state changing device and/or the state maintaining device, e.g. by means of actuators, motors, etc., such that the first state of the release/locking device can be adopted or maintained. Energy for such an operation of the state changing device and/or the state maintaining device can also be provided, by way of alternative or supplement, by a firearm internal process for a shot release when it is found in this connection that there is already a failure or a failure is imminent, adapted to or could prevent a shot release even if an authorization is available. For example, movements of the trigger, the trigger bar, the hammer, etc., can be used for this purpose.

Systems are described below, which, external to the firearm, control, in particular allow or prevent, the use of a firearm and in particular the firing of a shot in certain areas. The following explanations are made on the basis of a shooting stand as a non-limiting example for an area, in which further areas can be defined where shots may be fired or where this is not the case. Further examples comprise school grounds and other public facilities where the use of a firearm shall be prevented, areas, in which or into which the firing of shots shall be prevented, such as areas during a hunt where chasers (can) be, etc.

In an embodiment, a firearm is enabled for use when it is located at a shooting stand. Enabling means in particular that the safety apparatus of the firearm is ready for operation, i.e. can allow a shot to be fired or prevent a shot release depending on a user's authorization. Here, the basis is e.g. the area of the entire shooting stand or at least a certain part of the shooting stand where the firearm must be located to be enabled. Such an area is e.g. the area, in which a shooter should be to fire a shot to a target. The position of the firearm within the shooting stand can be determined by means of sensors, position detection systems, etc., in the shooting stand, GPS or comparable systems, radio-based or mobile radio-based (e.g. GSM, UMTS) position determination methods (e.g. triangulation) (e.g. GSM, UMTS), etc., optionally in connection with components arranged at or in the firearm.

It is also provided that the firearm is enabled and/or that the safety apparatus is informed that when an authorization is available a shot can be fired when the shot shall be fired in or into a certain area, e.g. to a target. On the other hand, the firearm cannot be enabled and/or an operation of the safety apparatus is prevented or not allowed when a shot shall be fired to an area not determined for this purpose, e.g. not to the target, but to areas, in which persons (may) stay. For this purpose, the position and orientation of the firearm can be detected, for example, to determine whether or not a shot shall be fired into an area intended for this purpose. The position and orientation of the firearm can be determined e.g. by means of sensors, position detection systems, etc., in the shooting stand, GPS or comparable systems, radio-based or mobile radio-based (e.g. GSM, UMTS) position determination methods (e.g. triangulation) (e.g. GSM, UMTS), etc., optionally in connection with components arranged at or in the firearm. This can (also) be done using a device, which is assigned to the target and which communicates with corresponding devices at and/or in the firearm in wireless, optical, etc. fashion.

The safety can be further increased by checking whether persons or something else at which no shots shall be fired stay in an area provided for firing shots. This can be done e.g. by sensors, which detect movements, obstacles, subjects, persons, etc. in the area provided for firing shots. If it is found that the area provided for firing shots contains something, which does not belong there, the firearm shall not be enabled and/or an operation of the safety apparatus shall be prevented or not allowed.

There may usually be situations where persons stay in areas, in which and/or into which shots may be fired. In order to prevent that shots are fired at such persons, it is possible to detect the position of a person in areas intended for firing shots and to prevent the firing of shots where necessary. In addition, devices can be provided, which detect whether a person stays in the field of fire. Such a device can comprise e.g. sensors, position detection systems, etc., GPS-based means or means based on comparable systems, radio-based or mobile radio-based (e.g. GSM, UMTS) position determination methods (e.g. triangulation) (e.g. GSM, UMTS), etc., and optionally cooperate with components arranged at or in the firearm. It is also possible to use devices, which communicate, with corresponding devices at and/or in the firearm in a wireless, optical, etc., fashion. Such devices can be integrated into clothing, jackets, helmets, safety jackets (as worn e.g. by chasers during a hunt), shoes and/or other items adapted to be worn by persons.

The invention claimed is:

1. A safety apparatus for a firearm, comprising:

a release/locking device adapted to be changed into a first state, which allows a shot to be fired, and into a second state, which prevents a shot from being fired, and a state changing device, which, in response to an initiation of a firearm internal process for a shot release, changes the release/locking device from the first state into the second state in an absence of authorization information and from the second state to the first state in a presence of authorization information; wherein the state changing device is adapted to return the release/locking device into the respective initial state in response to movements taking place in the firearm after a shot release.

2. A safety apparatus according to claim 1, also comprising a state maintaining device, which in response to the initiation of a firearm internal process for a shot release, maintains the release/locking device in the second state in the presence of authorization information.

3. A safety apparatus according to claim 1, also comprising an actuation device, which is adapted to change the release/locking device of the safety apparatus according to claim from the second state into the first state, wherein the actuation device is adapted to change the state of the release/locking device in a first time segment and wherein the state changing device is adapted to change the state of the release/locking device in a second time segment.

4. A safety apparatus according to claim 1, wherein the release/locking device comprises a firing pin for the firearm, wherein the firing pin is adapted to be rotated about a longitudinal axis of the firing pin into a first position and a second position, wherein the firing pin is in the first position of the firing pin as regards the first state of the release/locking device and in the second position of the firing pin as regards the second state of the release/locking device, and wherein the first position of the firing pin allows a shot release and the second position of the firing pin does not allow a shot release.

5. A safety apparatus according to claim 1, further comprising a control device for producing authorization information and/or comprising a receiving apparatus for receiving information specifying an authorization to use the firearm.

6. A firearm comprising a safety apparatus according to claim 1.

7. A firearm according to claim 6, also comprising a trigger, a trigger bar cooperating with the trigger and the release/locking device, and a hammer cooperating with the trigger bar.

8. A method for locking a firearm depending on an authorization to use the firearm, comprising:

initiating a firearm internal process for a shot release;

changing the firearm from a first state, which allows a shot to be fired, into a second state, which prevents a shot from being fired, in the absence of authorization information to use the firearm; and changing the firearm from the second state to the first state in the presence of authorization information to use the firearm; further comprising changing the release/locking device into the respective initial state in response to movements taking place in the firearm after a shot release.

9. A method according to claim 8, further comprising maintaining the firearm in the first state after authorization information to use the firearm is received.

10. A method according to claim 8, further comprising maintaining the firearm in the second state, when there is no authorization to use the firearm.

11. A method according to claim 8, comprising, only in response to an initiation of a firearm internal process for a shot release, evaluating whether there is an authorization to use the firearm.

12. A method according to claim 8, comprising evaluating whether there is an authorization indicating that a current user belongs to a special circle of people allowed to handle the firearm, and, in the case the authorization indicates that a current user belongs to a special circle of people, changing the firearm from the second state to the first state.

* * * * *